US010040178B2

(12) United States Patent
Kondo et al.

(10) Patent No.: US 10,040,178 B2
(45) Date of Patent: Aug. 7, 2018

(54) POWER TOOL AND ROTARY IMPACT TOOL

(71) Applicant: MAKITA CORPORATION, Anjo-shi, Aichi (JP)

(72) Inventors: Tomoyuki Kondo, Anjo (JP); Tokuo Hirabayashi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 520 days.

(21) Appl. No.: 14/698,186

(22) Filed: Apr. 28, 2015

(65) Prior Publication Data

US 2015/0343617 A1 Dec. 3, 2015

(30) Foreign Application Priority Data

May 27, 2014 (JP) ..... 2014-109288
May 27, 2014 (JP) ..... 2014-109289

(51) Int. Cl.
*B25B 21/02* (2006.01)
*B25F 5/00* (2006.01)

(52) U.S. Cl.
CPC ..... *B25B 21/02* (2013.01); *B25F 5/00* (2013.01); *B25F 5/006* (2013.01)

(58) Field of Classification Search
CPC ..... B25B 21/02; B25B 21/026; B25F 5/00; B25F 5/02; B25F 5/006; B24B 29/005
USPC ..... 53/170, 93
See application file for complete search history.

(56) References Cited

U.S. PATENT DOCUMENTS

2006/0091858 A1* 5/2006 Johnson ..... B25F 5/00 320/128
2008/0099224 A1* 5/2008 Hofmann ..... B25F 5/006 173/217
2010/0156350 A1* 6/2010 Murayama ..... H01M 2/1022 320/128
2010/0314147 A1* 12/2010 Muller ..... B25F 5/006 173/171

FOREIGN PATENT DOCUMENTS

CN 102189532 A 9/2011
JP H06-42010 U 6/1994
JP H06-47755 U 6/1994
JP 2000-515435 A 11/2000
JP 2002-273666 A 9/2002
(Continued)

OTHER PUBLICATIONS

Aug. 23, 2017 Office Action issued in Chinese Patent Application No. 201510274661.8.
(Continued)

*Primary Examiner* — Hemant M Desai
*Assistant Examiner* — Valentin Neacsu
(74) *Attorney, Agent, or Firm* — Oliff PLC

(57) ABSTRACT

To provide a power tool and a rotary impact tool capable of suppressing transmission of vibration to a circuit board and so on from a drive portion connecting to a motor as a vibration generation source. An impact wrench includes a motor housing which houses a motor or a grip housing, a battery holding housing connecting to the motor housing or the grip housing through an elastic body and a control circuit board housed in the battery holding housing for controlling the motor.

13 Claims, 23 Drawing Sheets

(56) References Cited

FOREIGN PATENT DOCUMENTS

| | | | |
|---|---|---|---|
| JP | 2005-224881 | A | 8/2005 |
| JP | 2007-283447 | A | 11/2007 |
| JP | 2008-302457 | A | 12/2008 |
| JP | 2011-045201 | A | 3/2011 |
| JP | 4981345 | B2 | 7/2012 |
| JP | 2012-218088 | A | 11/2012 |
| JP | 2013-063494 | A | 4/2013 |
| JP | 2013-115270 | A | 6/2013 |

OTHER PUBLICATIONS

Aug. 25, 2017 Drafted Office Action issued in Japanese Patent Application No. 2014-109289.
Aug. 25, 2017 Drafted Office Action issued in Japanese Patent Application No. 2014-109288.
Jan. 31, 2018 Office Action issued in Japanese Patent Application No. 2014-109288.

* cited by examiner

POWER TOOL AND ROTARY IMPACT TOOL

This application claims the benefit of Japanese Patent Application Numbers 2014-109288 and 2014-109289 filed on May 27, 2014, the entirety of which is incorporated by reference.

BACKGROUND OF THE INVENTION

Field of the Invention

The present invention relates to a power tool capable of applying a rotational force to an output portion and a rotary impact tool capable of applying a rotational impact force to the output portion.

Description of Related Art

As disclosed in Japanese Patent Application Publication No. 2011-45201 (JP 2011-45201-A), an impact driver which transmits the rotation of a drive rotation shaft of a motor to an output shaft after decelerating the rotation has been known.

In such impact driver, a circuit board is housed in a lower end portion of a hand grip connecting to a motor housing, and a battery attaching portion is provided below the lower end portion.

Further, in the impact driver, the rotation is decelerated by a planetary gear mechanism having one internal gear and two planetary gears which is arranged between the drive rotation shaft and the output shaft. The two planetary gears are engaged with the rotation drive shaft and the internal gear, and pins passing the center of respective planetary gears enter a base portion of a spindle connecting to the output shaft. The two planetary gears enter the same vertical plane, which forms a one-stage structure.

SUMMARY OF THE INVENTION

In the impact driver disclosed in JP 2011-45201-A, the circuit board is housed in the lower end portion of the hand grip connecting to the motor housing. Therefore, vibration generated in a drive portion connecting to the motor may reach the circuit board through the hand grip, so that devices and the like mounted on the circuit board may be affected by receiving the vibration for a long period of time.

In view of the above, an object of the present invention is to provide a power tool and a rotary impact tool capable of suppressing the transmission of vibration from the drive portion as a vibration generation source with respect to the circuit board and so on.

Further, the impact driver disclosed in JP 2011-45201-A is decelerated by the planetary gear mechanism having one-stage planetary gears, therefore, an outer diameter of the internal gear is increased as a reduction ratio by the gear is increased.

In view of the above, another object of the present invention is to provide a power tool and a rotary impact tool having a deceleration mechanism in which a reduction ratio is high by the gear with a compact internal gear.

In order to achieve the object, according to an embodiment of the present invention, there is provided a power tool including a first housing which houses a motor, a second housing connecting to the first housing through an elastic body, and a control circuit board housed in the second housing for controlling the motor.

In order to achieve the object, in the power tool according to the embodiment of the present invention, a grip housing may be formed in the first housing, and a battery holding housing may be formed in the second housing.

In order to achieve the object, in the power tool according to the embodiment of the present invention, a display portion displaying the state of the power tool may be formed in the battery holding housing.

In order to achieve an object of improving a vibration control effect with respect to a control circuit board in addition to the above object, in the power tool according to the embodiment of the present invention, the control circuit board may be held through a case made of a resin.

In order to achieve the object of improving the vibration control effect with respect to the control circuit board in addition to the above object, in the power tool according to another embodiment of the present invention, the control circuit board may be held through a case made of a resin.

In order to achieve an object of arranging the control circuit board easily in addition to the above object, in the power tool according to the embodiment of the present invention, the control circuit board may have a capacitor, and the capacitor may be arranged in the central part in a right and left direction of the control circuit board.

In order to achieve the object of arranging the control circuit board easily in addition to the above object, in the power tool according to another embodiment of the present invention, the control circuit board may have a capacitor, and the capacitor may be arranged in the center area in a right and left direction of the control circuit board.

In order to achieve the object of arranging the control circuit board easily in addition to the above object, in the power tool according to further another embodiment of the present invention, the control circuit board may have a capacitor, and the capacitor may be arranged in the center area in a right and left direction of the control circuit board.

In order to achieve an object of suppressing transmission of vibration with respect to the control circuit board also in the rotary impact tool in addition to the above object, according to the embodiment of the present invention, there is provided a rotary impact tool including an impact mechanism which impacts on an output portion.

In order to achieve the object of suppressing transmission of vibration with respect to the control circuit board also in the rotary impact tool in addition to the above object, according to another embodiment of the present invention, there is provided a rotary impact tool including an impact mechanism which impacts on an output portion.

In order to achieve the object of suppressing transmission of vibration with respect to the control circuit board also in the rotary impact tool in addition to the above object, according to further another embodiment of the present invention, there is provided a rotary impact tool including an impact mechanism which impacts on an output portion.

In order to achieve another object, according to another embodiment of the present invention, there is provided a power tool including a motor having a motor shaft, a pinion gear rotated by the motor shaft, a first planetary gear engaged with the pinion gear, a second planetary gear fixed to the first planetary gear and rotating with the first planetary gear, an internal gear engaged with the second planetary gear, a carrier holding the first planetary gear and the second planetary gear and an output portion connecting to the carrier.

In order to achieve another object, according to another embodiment of the present invention, there is provided a power tool including a motor having a motor shaft, a motor housing which houses the motor, a gear housing fixed to the motor housing, a bearing held in the gear housing, a pinion gear rotated by the motor shaft, a first planetary gear engaged with the pinion gear, a second planetary gear fixed to the first planetary gear and rotating with the first planetary gear, an internal gear engaged with the second planetary gear and fixed to the gear housing, a carrier holding the first planetary gear and the second planetary gear and an output portion connecting to the carrier.

In order to achieve an object of forming a compact decelerating mechanism capable of performing deceleration sufficiently in a simpler structure in addition to the above object, in the power tool according to the embodiment of the present invention, the first planetary gear may be fixed to a side close to the motor in the second planetary gear.

In order to achieve the object of forming the compact decelerating mechanism capable of performing deceleration sufficiently in a simpler structure in addition to the above object, in the power tool according to another embodiment of the present invention, the first planetary gear may be fixed to a side close to the motor in the second planetary gear.

In order to achieve the object of forming a more compact deceleration mechanism capable of performing deceleration sufficiently in addition to the above object, in the power tool according to the embodiment of the present invention, the first planetary gear may be fixed to a side close to the output portion in the second planetary gear.

In order to achieve the object of forming the more compact deceleration mechanism capable of performing deceleration sufficiently in addition to the above object, in the power tool according to another embodiment of the present invention, the first planetary gear may be fixed to a side close to the output portion in the second planetary gear.

In order to achieve an object of forming a compact deceleration mechanism capable of performing deceleration sufficiently also in the rotary impact tool in addition to the above object, according to the embodiment of the present invention, there is also provided a rotary impact tool including an impact mechanism which impacts on an output portion.

In order to achieve the object of forming the compact deceleration mechanism capable of performing deceleration sufficiently also in the rotary impact tool in addition to the above object, according to another embodiment of the present invention, there is also provided a rotary impact tool including an impact mechanism which impacts on an output portion.

According to the embodiment of the present invention, there is an advantage that it is possible to provide the power tool and the rotary impact tool capable of suppressing the transmission of vibration with respect to the control circuit board and so on.

Further, according to the embodiment of the present invention, there is an advantage that it is possible to provide the compact power tool and the rotary impact tool capable of performing deceleration sufficiently.

DESCRIPTION OF EMBODIMENTS

Hereinafter, embodiments of the present invention will be appropriately explained with reference to the drawings.

Front, rear, top, bottom, right and left in the embodiments are determined for convenience of explanation, and may be relatively changed according to the working state and so on.

[First Embodiment]

Figure 1:
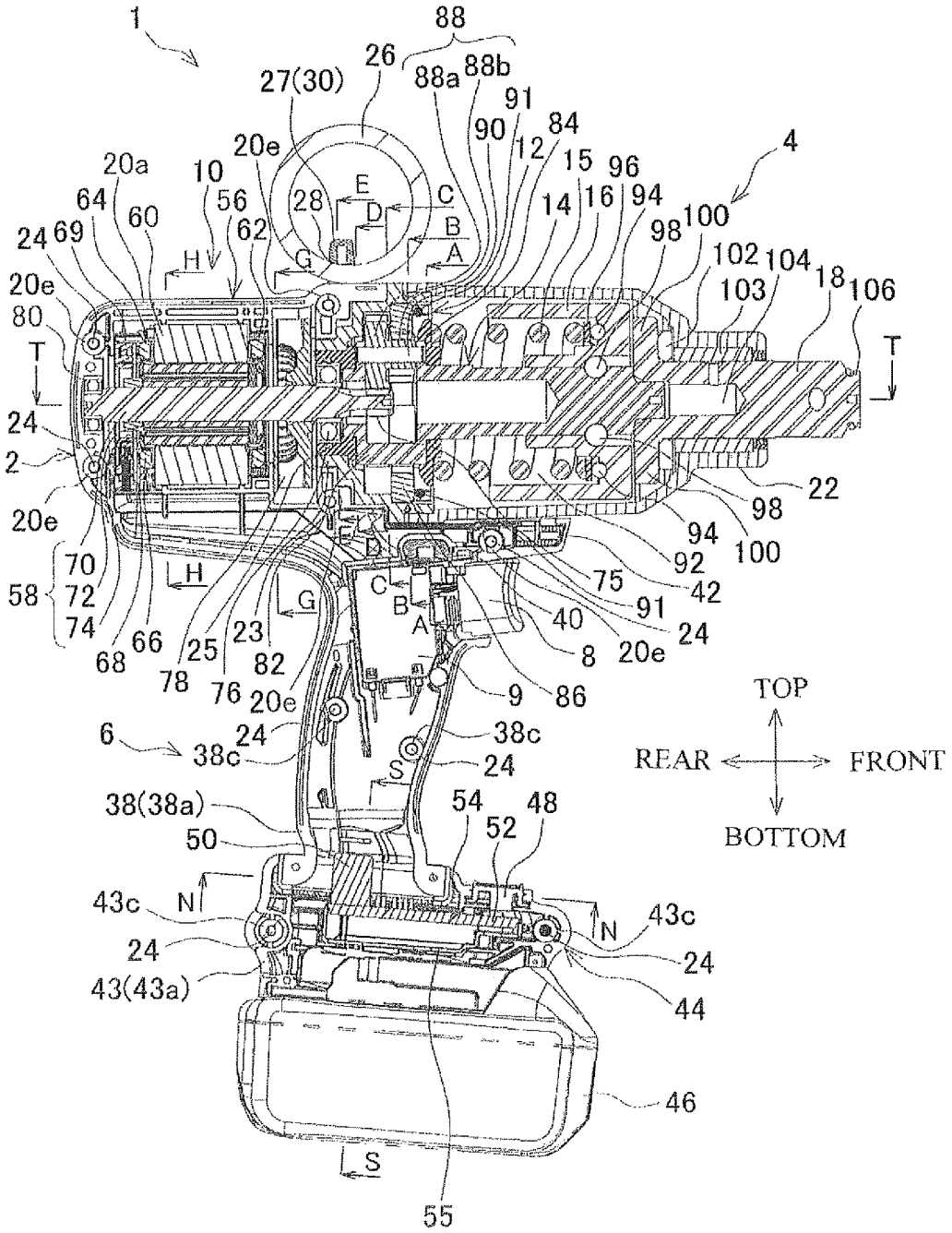
FIG. 1 is a partial vertical cross-sectional view taken along the center of an impact wrench according to a first embodiment of the present invention.
Figure 2:
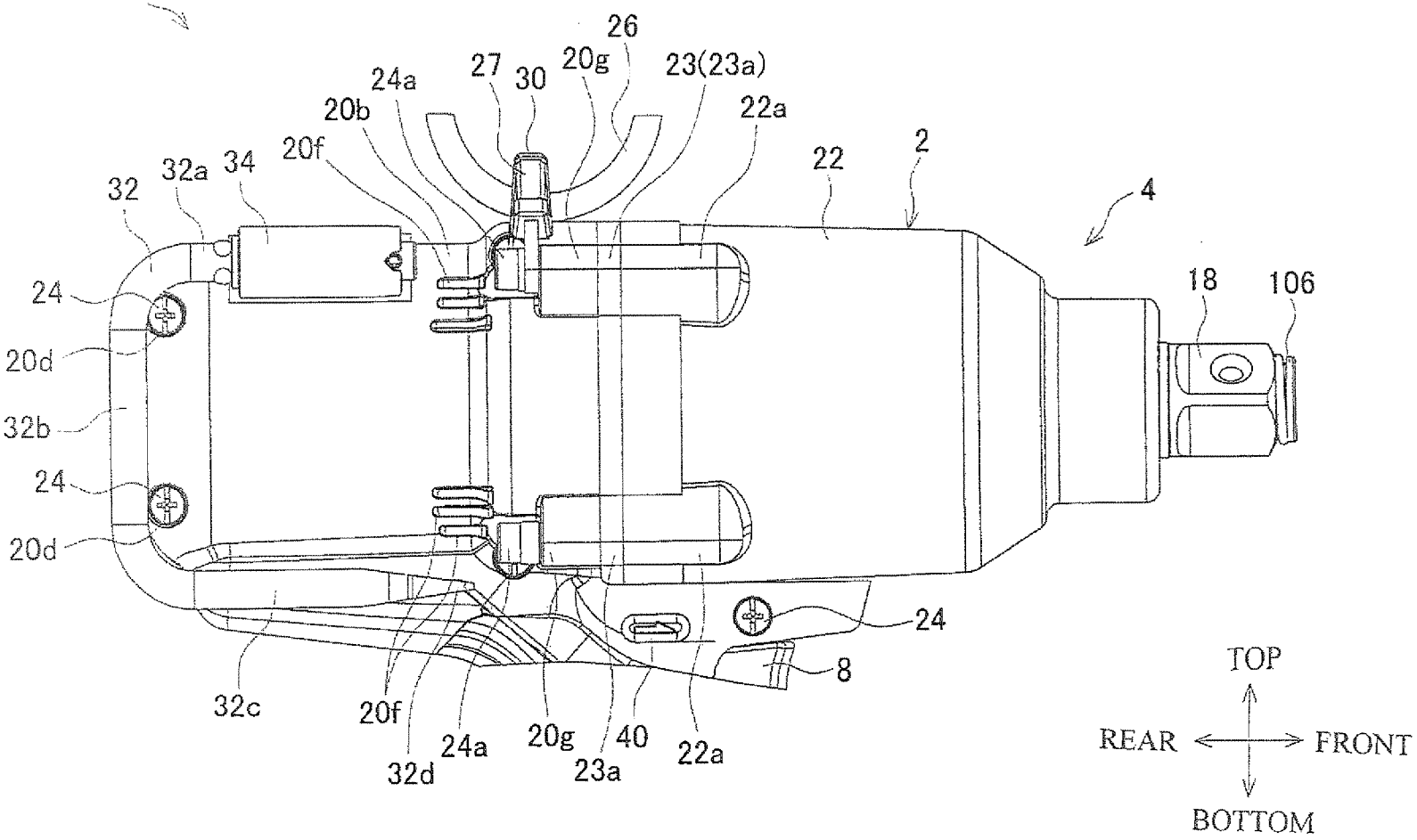
FIG. 2 is a partial right side view of FIG. 1.
Figure 3:
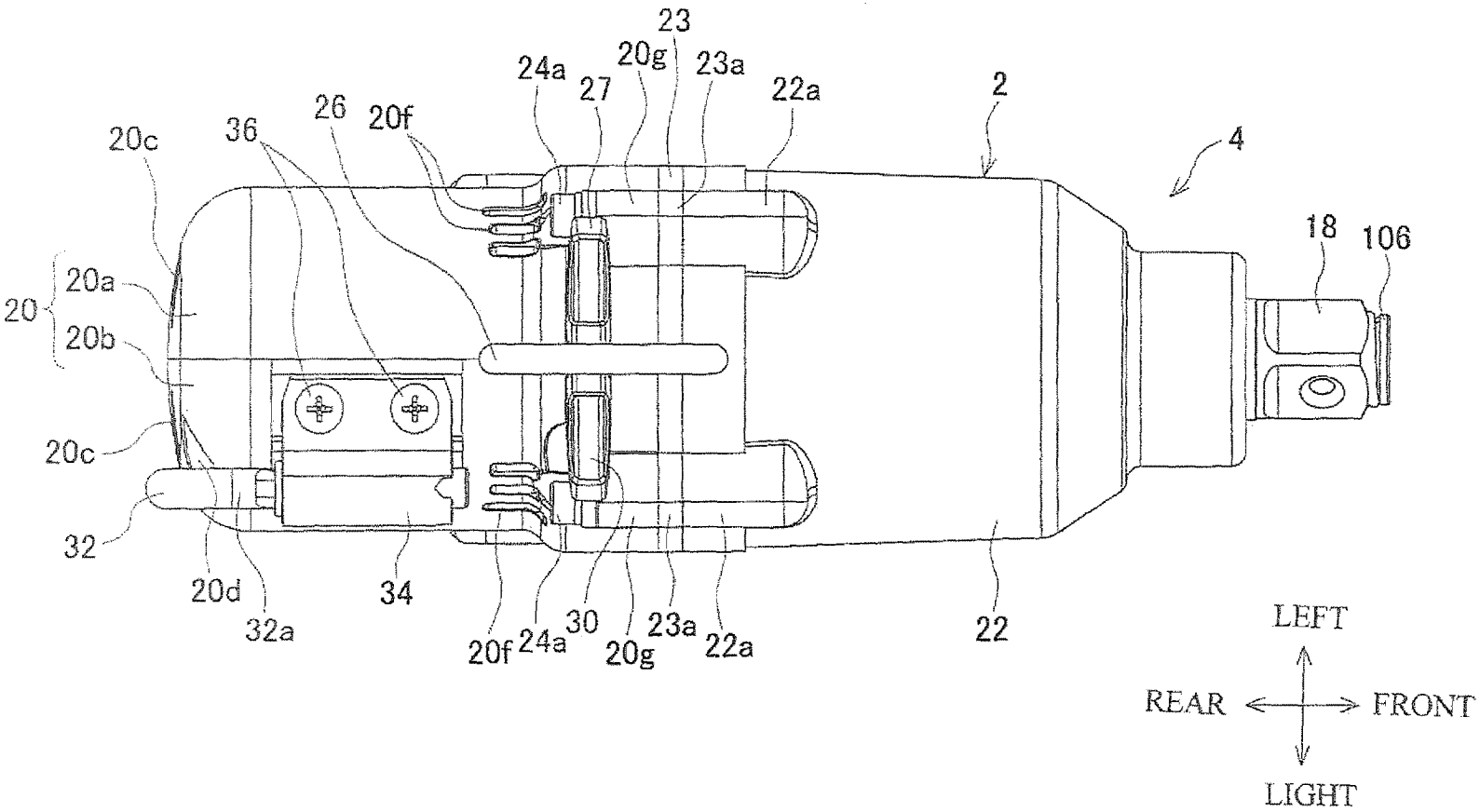
FIG. 3 is a top view of FIG. 1.
Figure 4:
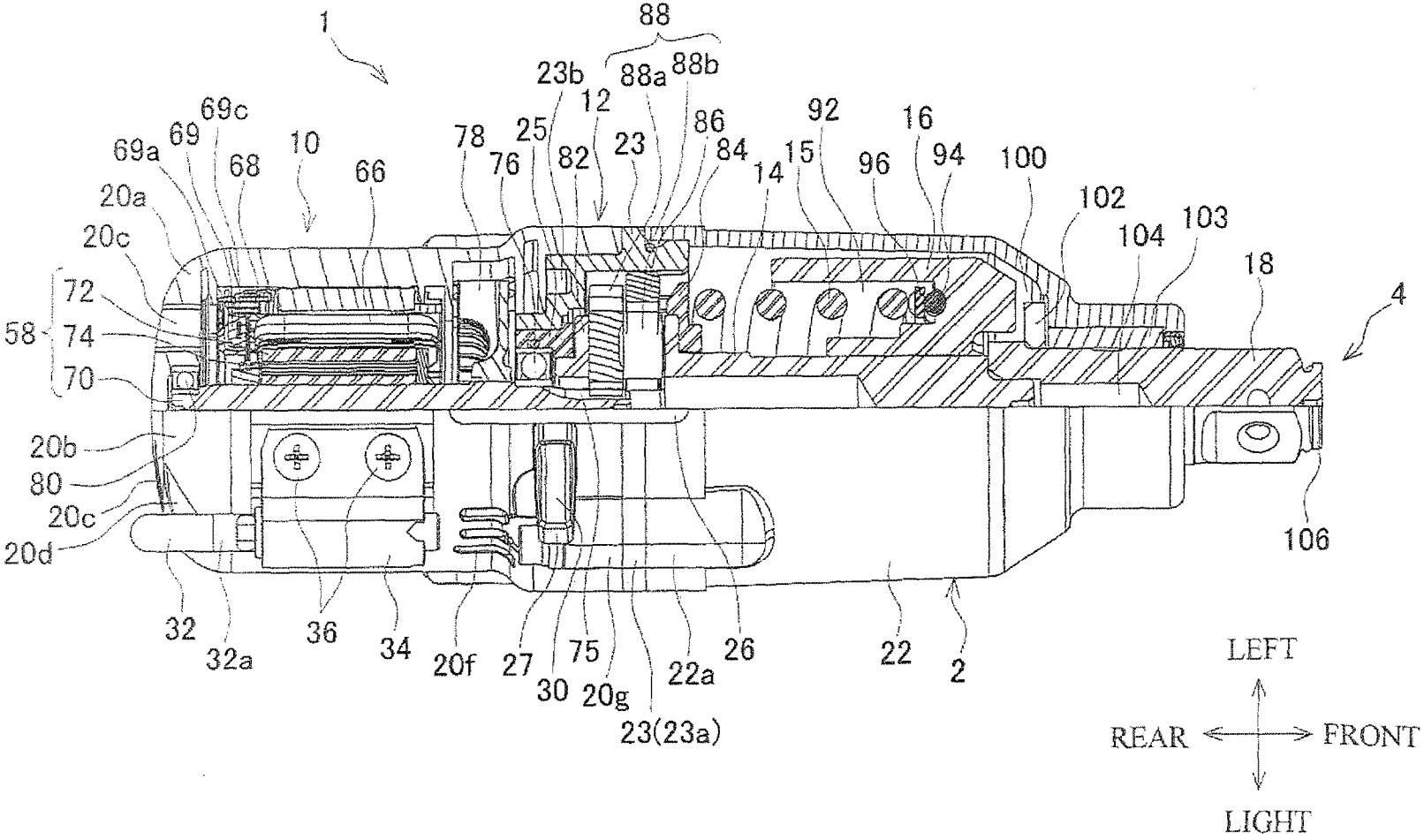
FIG. 4 is a view of a cross section of half of FIG. 3, which is taken along T-T line of FIG. 1.
Figure 5:
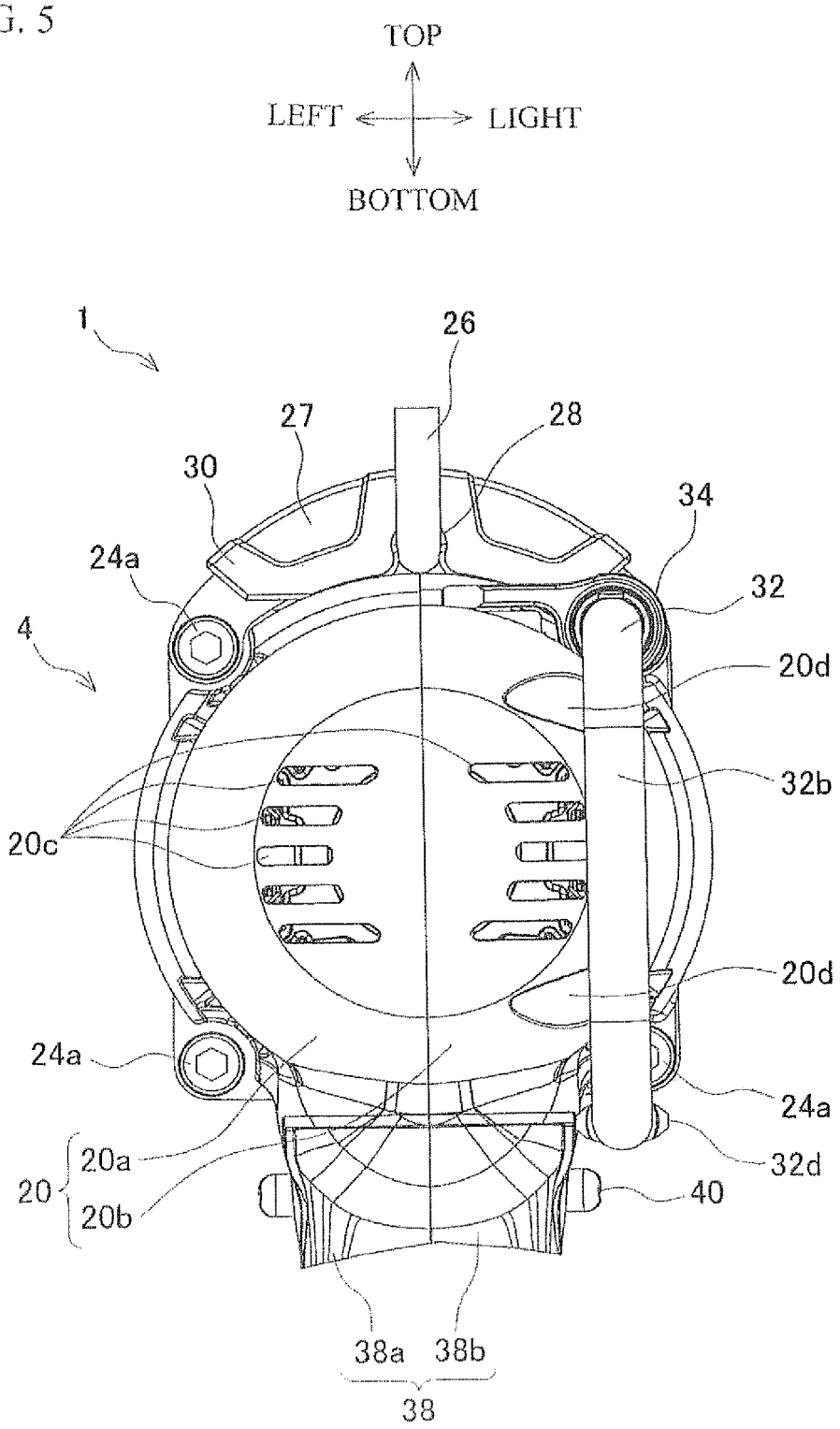
FIG. 5 is a partial rear view of FIG. 1.
Figure 6:
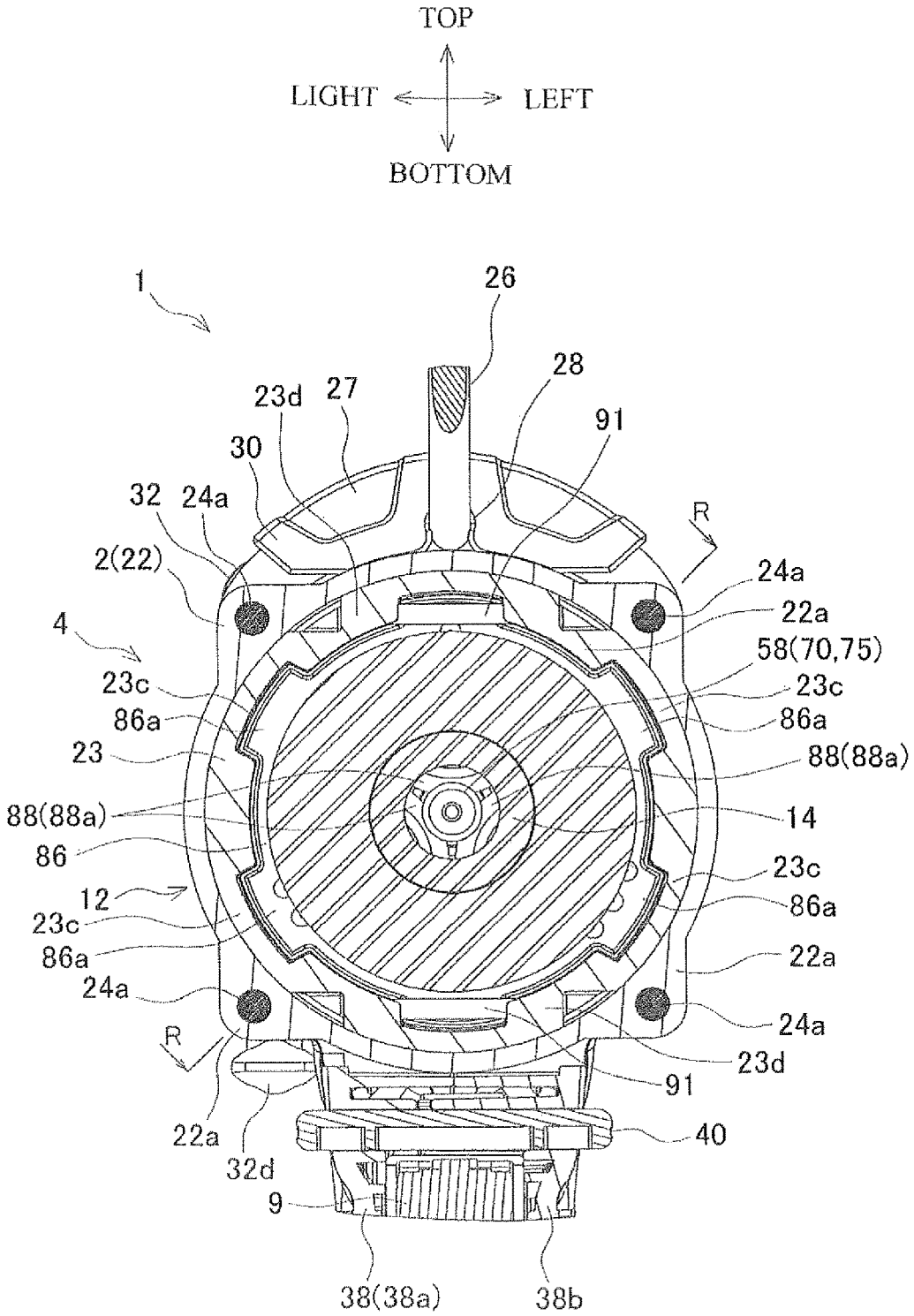
FIG. 6 is a partial cross-sectional view taken along A-A line of FIG. 1.
Figure 7:
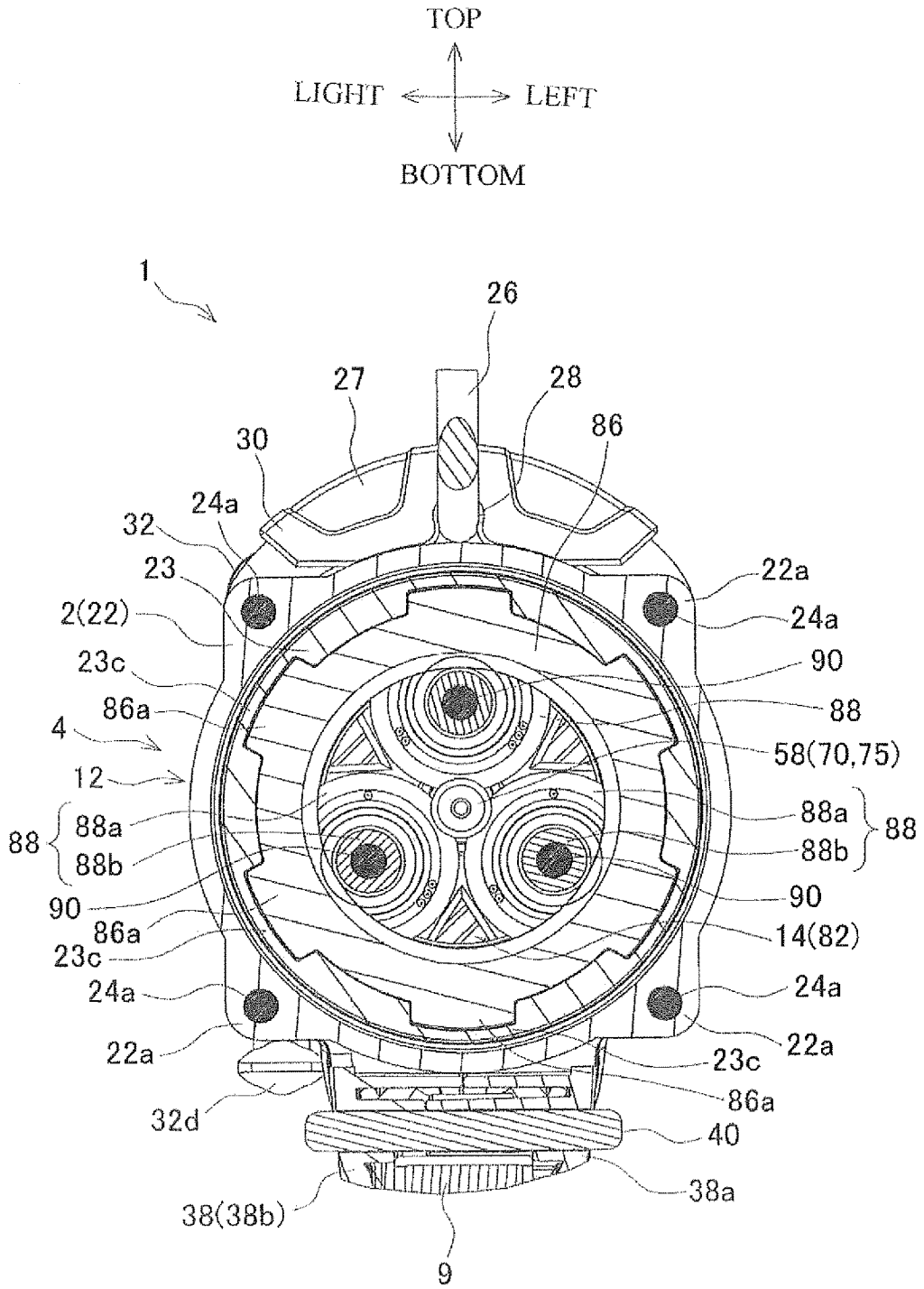
FIG. 7 is a partial cross-sectional view taken along B-B line of FIG. 1.
Figure 8:
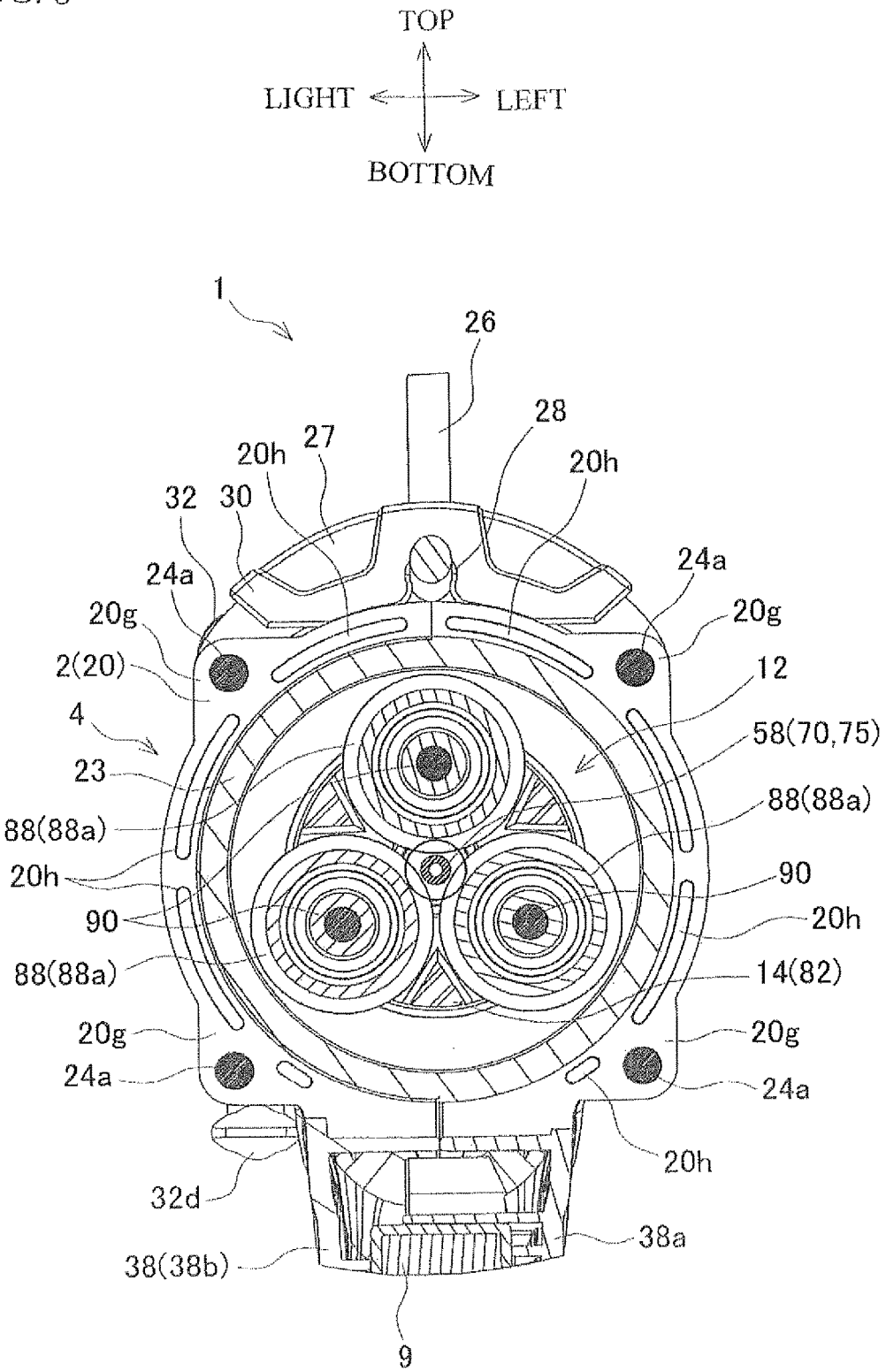
FIG. 8 is a partial cross-sectional view taken along C-C line of FIG. 1.
Figure 9:
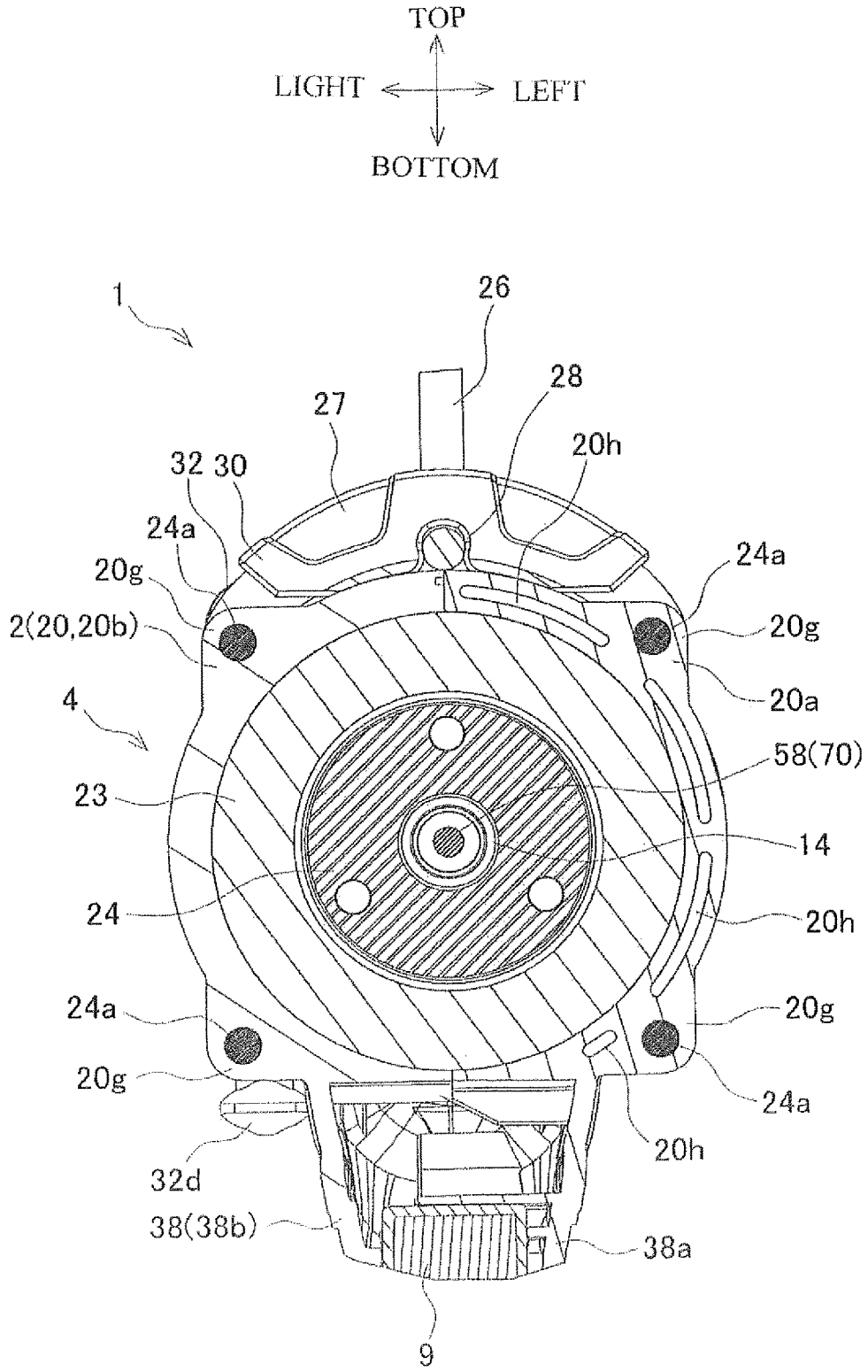
FIG. 9 is a partial cross-sectional view taken along D-D line of FIG. 1.
Figure 10:
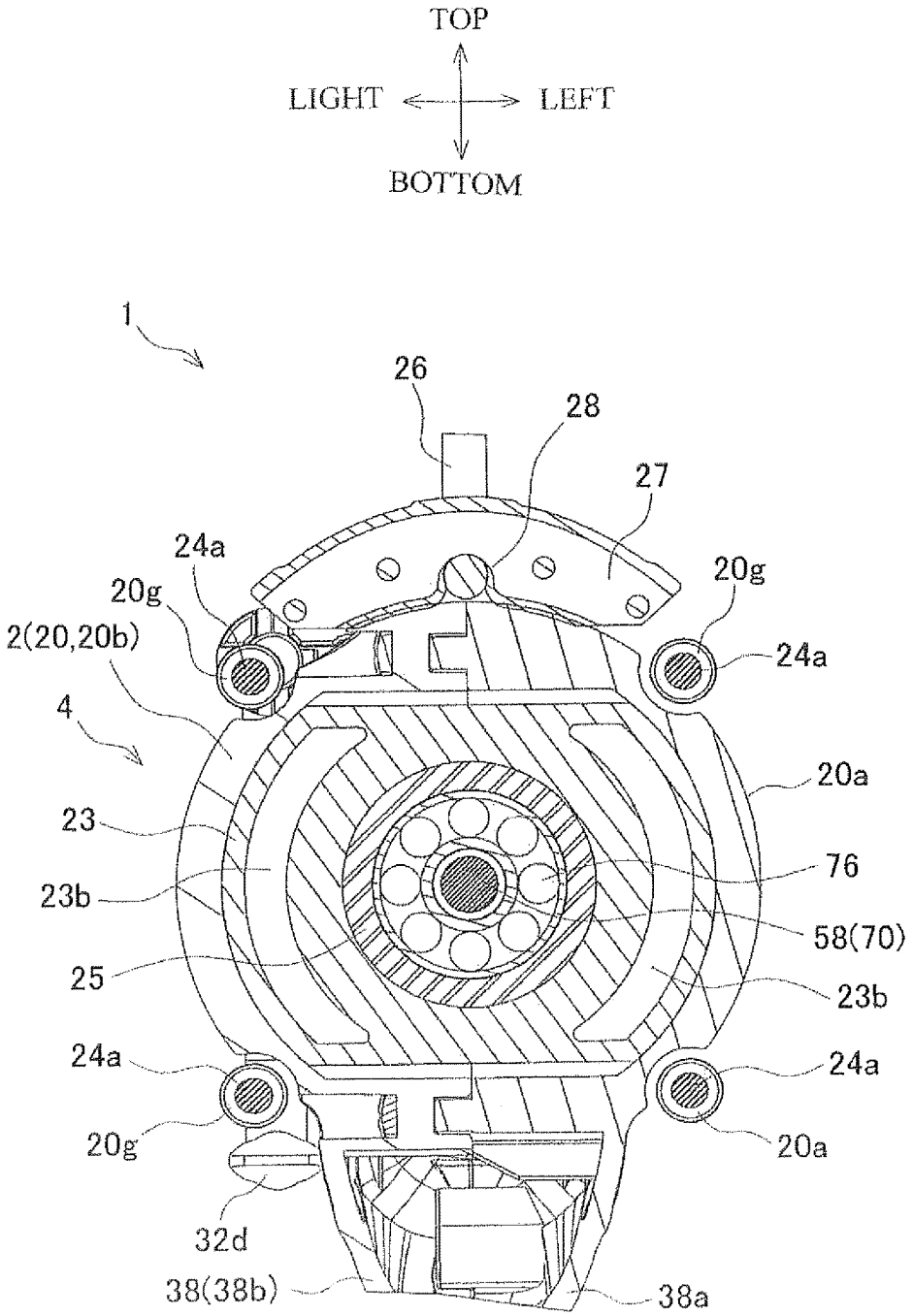
FIG. 10 is a partial cross-sectional view taken along E-E line of FIG. 1.
Figure 11:
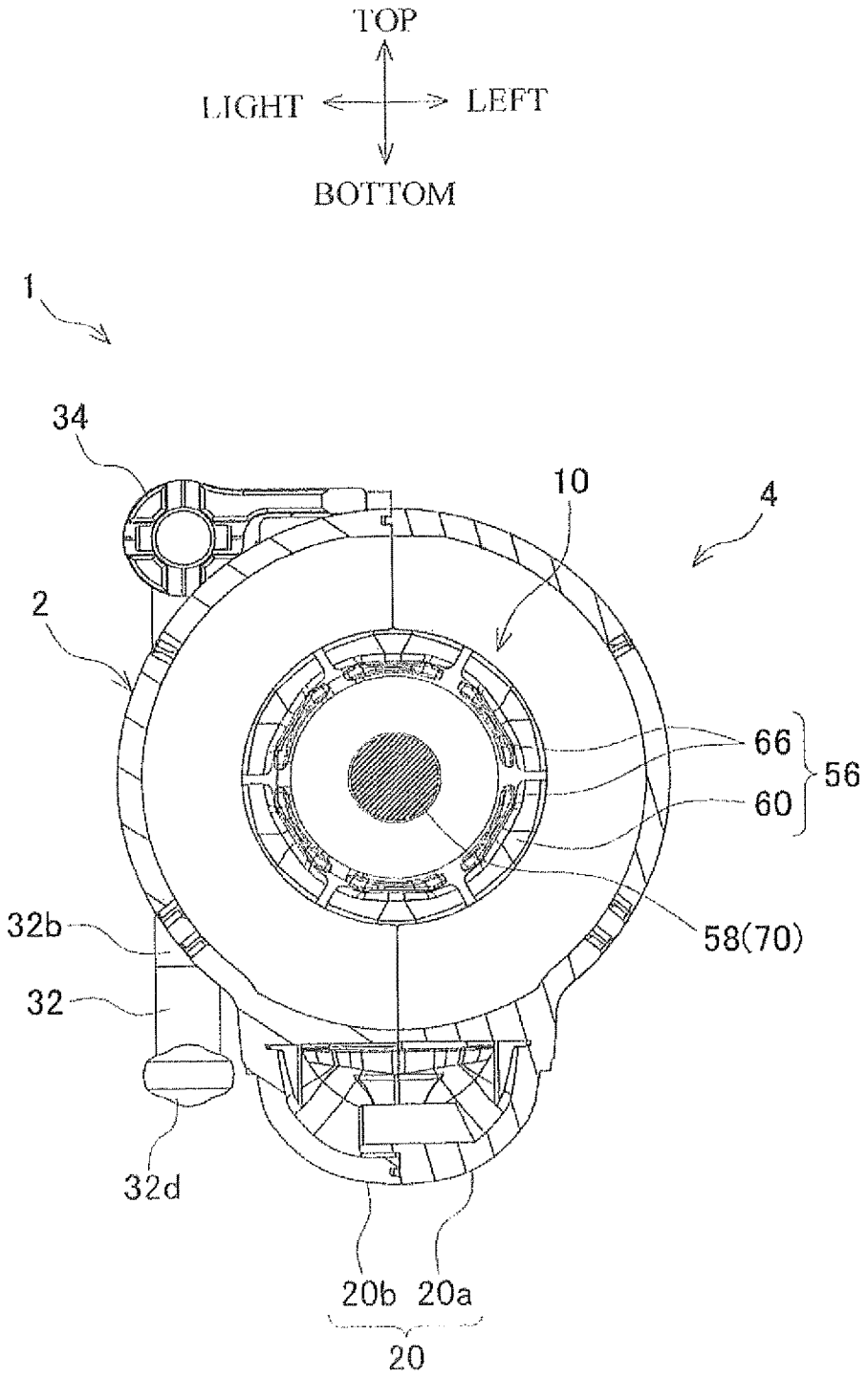
FIG. 11 is a cross-sectional view taken along G-G line of FIG. 1.
Figure 12:
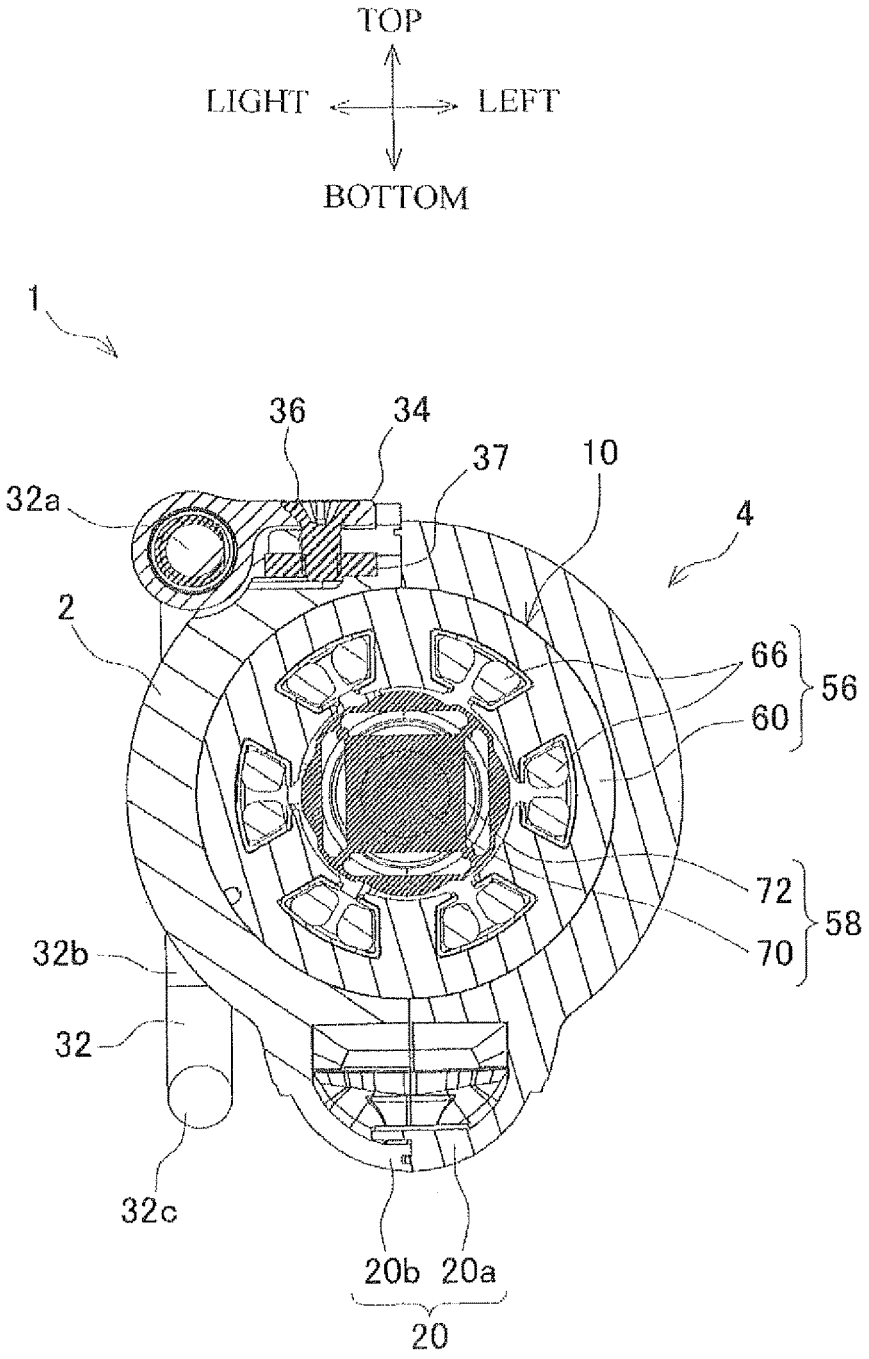
FIG. 12 is a partial cross-sectional view taken along H-H line of FIG. 1.
Figure 13:
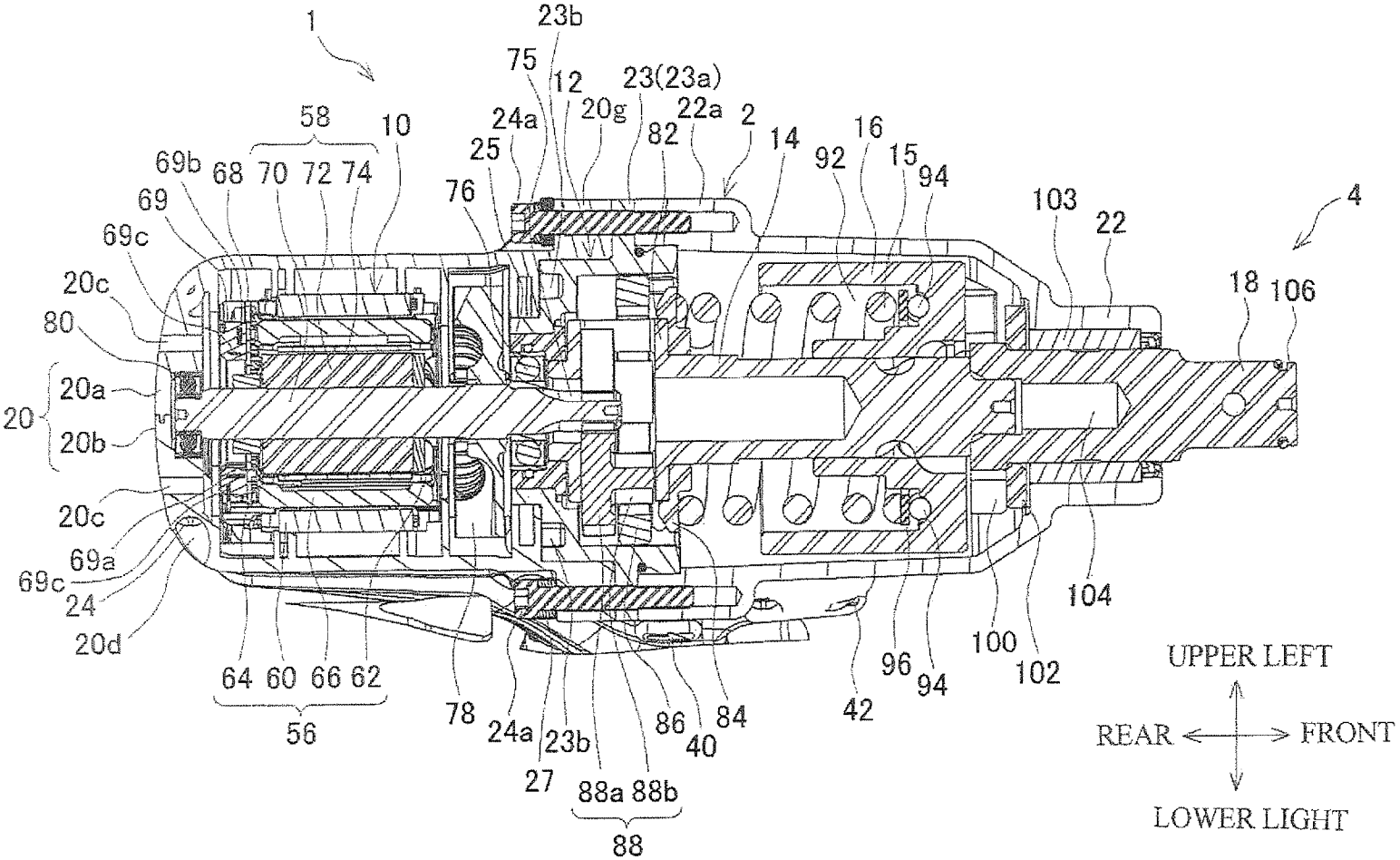
FIG. 13 is a cross-sectional view taken along R-R line of FIG. 6.
Figure 14:
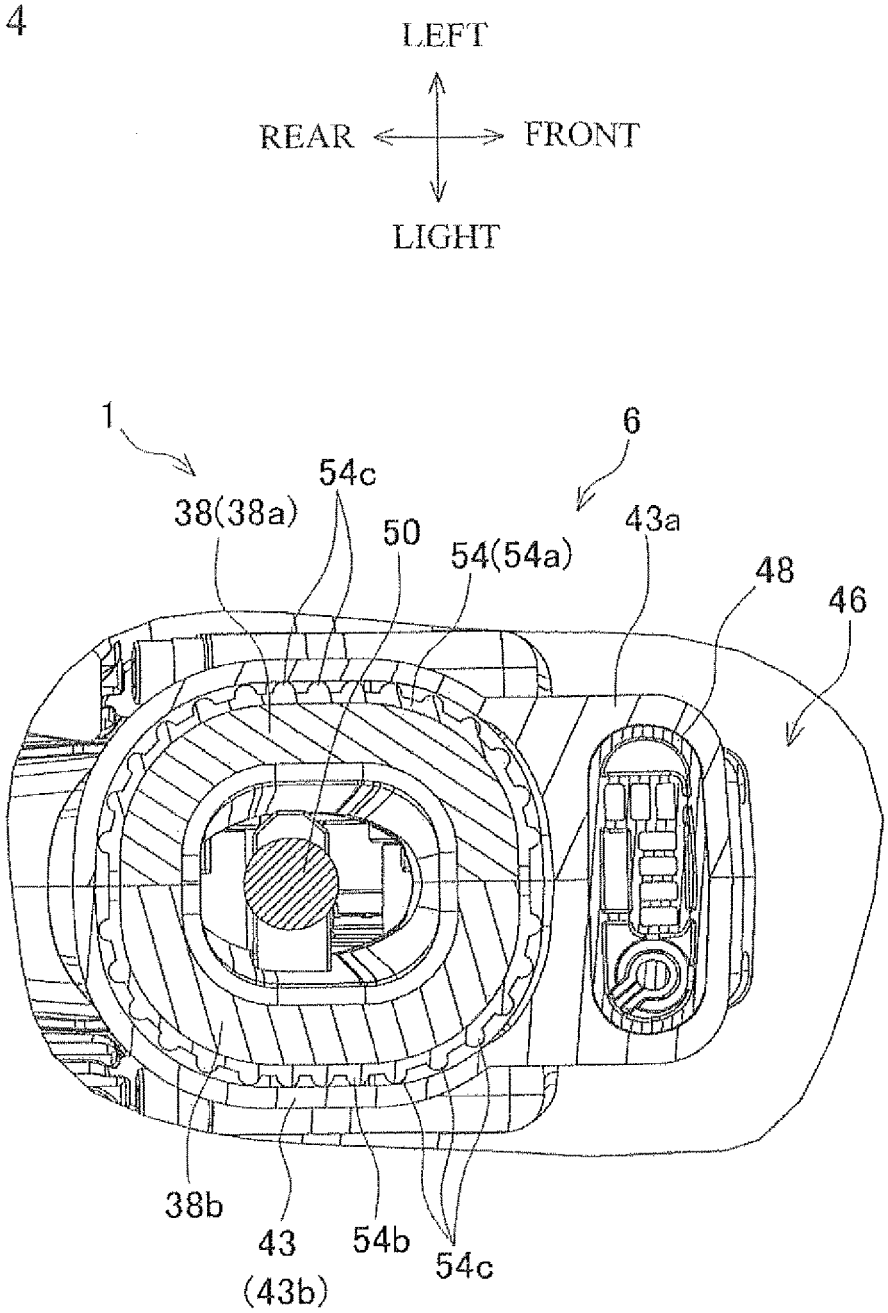
FIG. 14 is a partial cross-sectional view taken along N-N line of FIG. 1.
Figure 15:
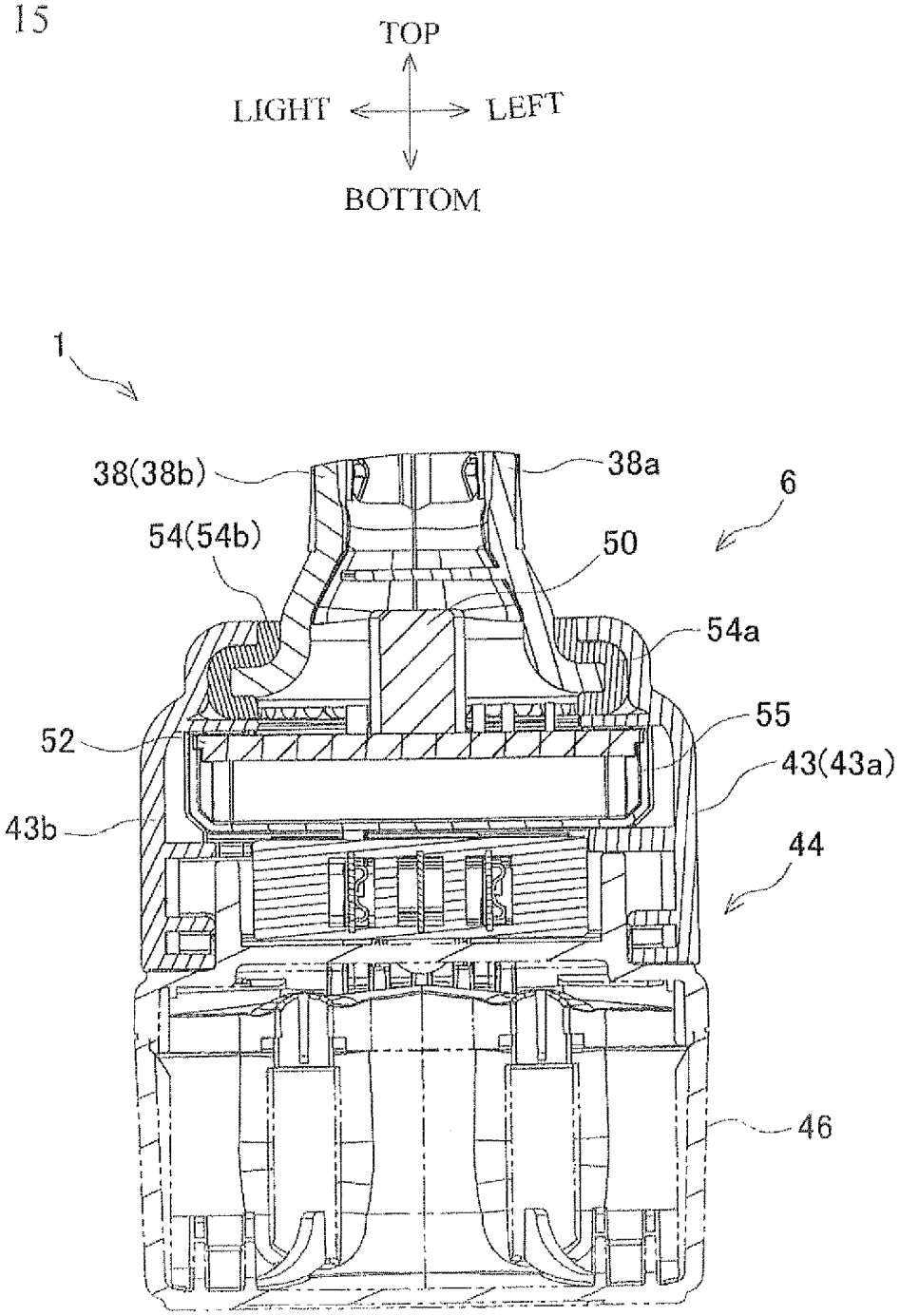
FIG. 15 is a cross-sectional view taken along S-S line of FIG. 1.
Figure 16:
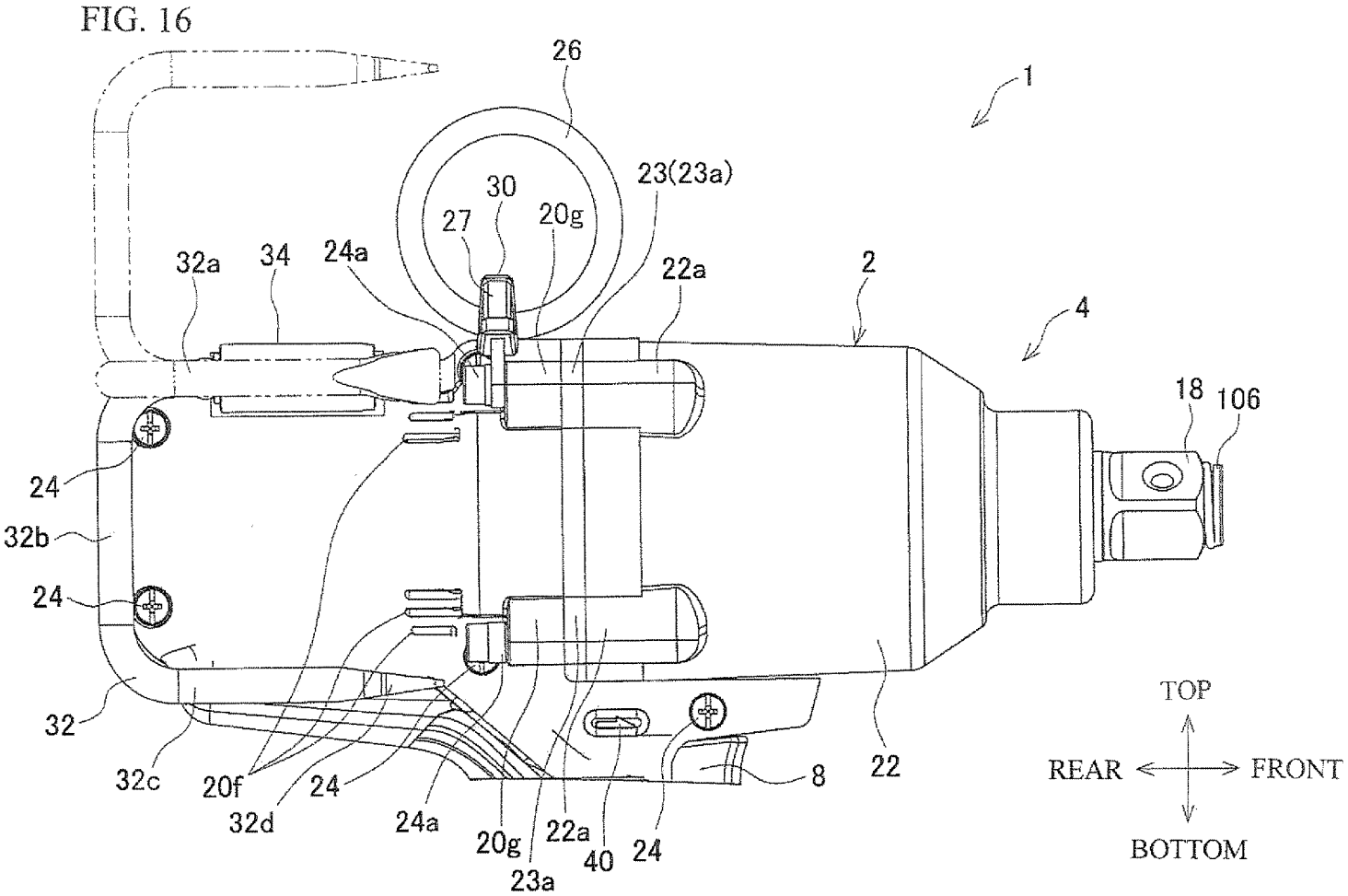
FIG. 16 is a view corresponding to FIG. 2 for explaining a hook.
Figure 17:
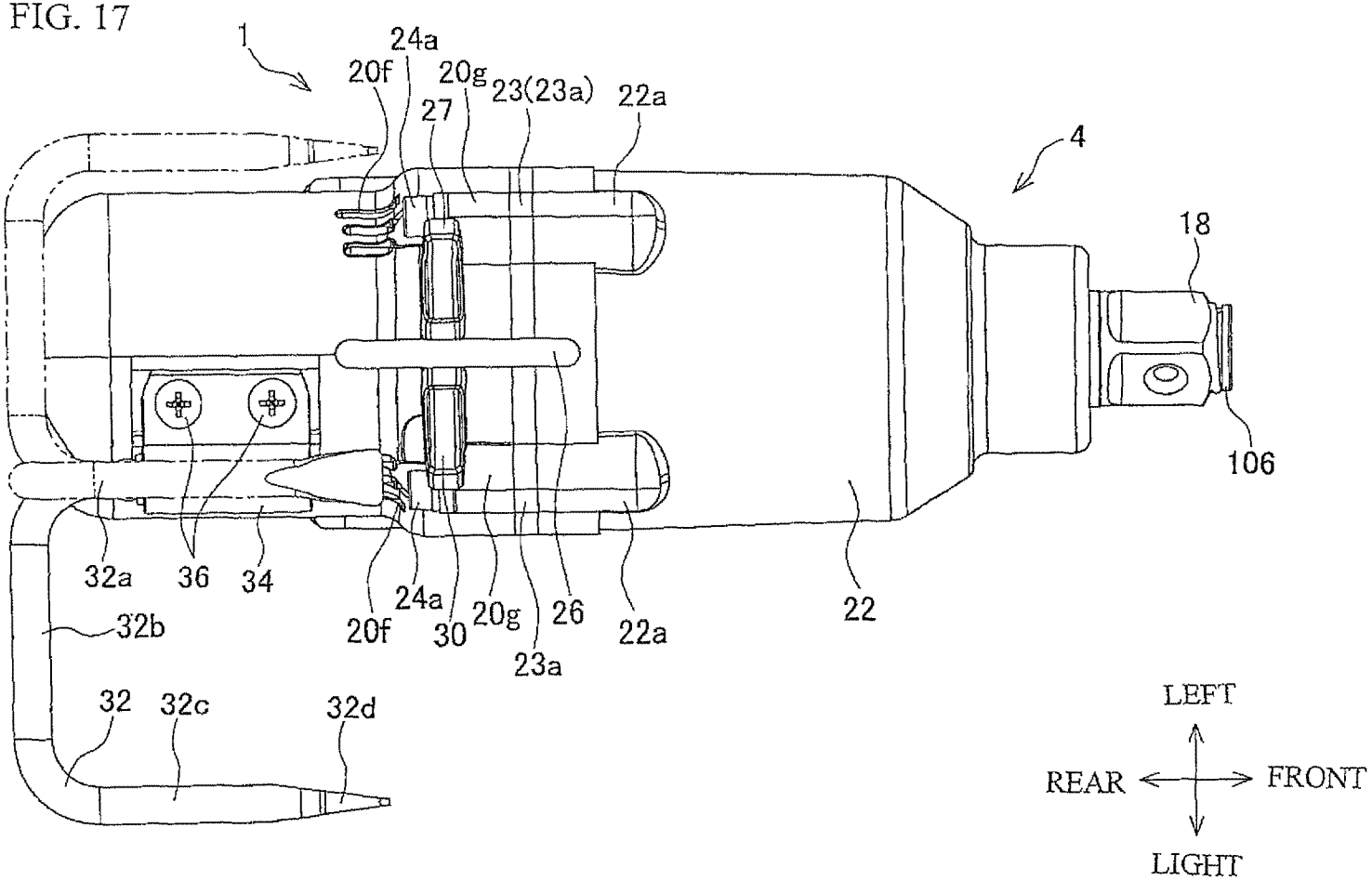
FIG. 17 is a view corresponding to FIG. 3 for explaining the hook.
Figure 18:
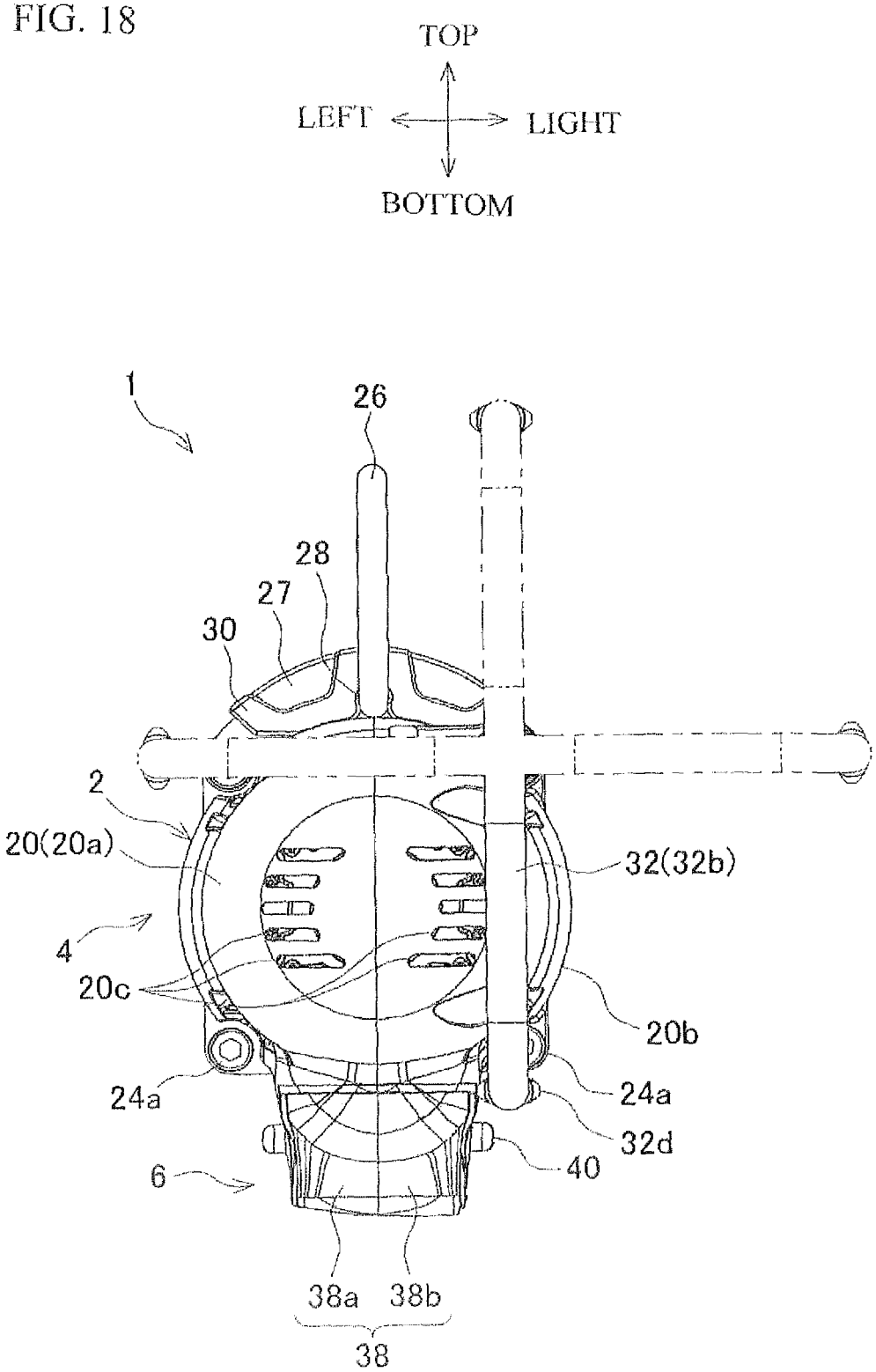
FIG. 18 is a view corresponding to FIG. 5 for explaining the hook.

FIG. 1 is a vertical cross-sectional view taken along the center of a rechargeable impact wrench (rotary impact tool) 1 as an example of a power tool according to a first embodiment of the present invention. FIG. 2 is a partial right side view of the impact wrench 1. FIG. 3 is a top view of the impact wrench 1. FIG. 4 is a top view and a horizontal (T-T line) cross-sectional view of the impact wrench 1. FIG. 5 is a partial rear view of FIG. 1. FIG. 6 is a partial cross-sectional view taken along A-A line of FIG. 1. FIG. 7 is a partial cross-sectional view taken along B-B line of FIG. 1. FIG. 8 is a partial cross-sectional view taken along C-C line of FIG. 1. FIG. 9 is a partial cross-sectional view taken along D-D line of FIG. 1. FIG. 10 is a partial cross-sectional view taken along E-E line of FIG. 1. FIG. 11 is a cross-sectional view taken along G-G line of FIG. 1. FIG. 12 is a cross-sectional view taken along H-H line of FIG. 1. FIG. 13 is a cross-sectional view take along R-R line of FIG. 6. FIG. 14 is a partial cross-sectional view taken along N-N line of FIG. 1. FIG. 15 is a cross-sectional view taken along S-S line of FIG. 1. FIG. 16 is a partial right side view of the impact wrench 1 for explaining a hook. FIG. 17 is a top view of the impact wrench 1 for explaining the hook. FIG. 18 is a partial rear view of the impact wrench 1 for explaining the hook.

The impact wrench 1 has a housing 2 forming an outline thereof. In FIG. 1, the right side corresponds to the front, the top side corresponds to the top. In FIG. 3, the right side corresponds to the front and the top side corresponds to the left.

The impact wrench 1 includes a columnar body portion 4 in which the central axis extends in a front and rear direction and a grip portion 6 formed so as to project from a lower portion of the body portion 4.

The grip portion 6 is a portion gripped by a user, and a trigger-type switch lever 8 which can be pulled by a finger tip of the user is provided in a base end portion of the grip portion 6. The switch lever 8 projects from a switch body portion 9.

A motor (a brushless DC motor) 10, a planetary gear mechanism 12, a spindle 14 as a carrier, a coil-shaped spring 15 as an elastic body, a hammer 16 and an anvil 18 as an output portion are coaxially housed in the body portion 4 of the impact wrench 1 in the order from the rear side.

The motor 10 is a drive source of the impact wrench 1, and the rotation thereof is transmitted to the spindle 14 after being decelerated by the planetary gear mechanism 12. Then, a rotational force of the spindle 14 reaches the anvil 18. The rotational force of the spindle 14 is converted into a rotational impact force appropriately by the hammer 16 (impact mechanism), which is transmitted to the anvil 18 while being buffered by the spring 15 stretched between the spindle 14 and the hammer 16. The anvil 18 is a portion rotating around an axis by receiving the rotational force or the rotational impact force.

The housing 2 according to the body portion 4 includes a motor housing 20 housing the motor 10, a hammer case 22 arranged in front of the motor housing 20 and housing the hammer 16 and a gear housing 23 arranged between the motor housing 20 and the hammer case 22 to be an outline of the planetary bear mechanism 12.

The motor housing 20 includes a left motor housing 20*a* and a right motor housing 20*b* having a half bottomed cylindrical shape. When the left motor housing 20*a* and the right motor housing 20*b* are combined, they have a bottomed cylindrical shape which opens to the front and covers a rear, top, bottom, left and right portions. Air inlets 20*c*, 20*c* are opened in respective rear portions of the left motor housing 20*a* and the right motor housing 20*b*. Further, screw holes 20*d*, 20*d* are opened along the right and left direction respectively at top and bottom portions in the rear portion of the right motor housing 20*b*, and each screw boss 20*e* is provided at portions facing corresponding screw holes 20*d* in the rear portion of the left motor housing 20*a*. Screws 24 are inserted from the right side into the screw holes 20*d* and the screw bosses 20*e*. Moreover, air outlets 20*f*, 20*f* are opened in the left motor housing 20*a* and the right motor housing 20*b*. Additional three (five in total) screw bosses 20*e* are provided in the motor housing 20 (see FIG. 1).

The hammer case 22 is a tubular shape in which a front portion is reduced in diameter as compared with a rear portion, and a rear end portion thereof is arranged on the front side of a front end portion of the motor housing 20 through the gear housing 23.

The gear housing 23 has a cup shape extending in top, bottom, right and left directions and increased in diameter to the front side, a front portion of which is sandwiched between the motor housing 20 and the hammer case 22.

A hole is opened in a rear portion of the gear housing 23, and a metal bearing retainer 25 as a bearing retaining wall is attached to the inside of the hole.

Additionally, on a vertical ring-shaped wall arranged in a boundary between the front portion and the rear portion of the gear housing 23, recess portions 23*b*, 23*b* which are recessed from the rear surface to the front side are provided. The respective recess portions 23*b* have an arc shape, which are positioned at left or right of the bearing retainer 25. Furthermore, in a thick wall part (front surface) of an opening at the front portion of the motor housing 20, plural arc-shaped recess portions 20*h*, 20*h* are formed. As the recess portions 23*b*, 23*b*, 20*h*, 20*h* are formed, surface areas of the gear housing 23 and the motor housing 20 are further increased so that heat can be released further easily.

Bolt hole portions 20*g*, 23*a* having bolt holes extending in the front and rear direction are formed in the front portion of the motor housing 20 and the front portion of the gear housing 23. Screw boss portions 22*a* extending in the front and rear direction are respectively formed in portions corresponding to the bolt hole portions in the hammer case 22. Bolts 24*a* are inserted in common into the bolt hole portions 20*g*, 23*a* and the screw boss portions 22*a* overlapping each other from the rear direction. The bolts 24*a*, 24*a*, the bolt hole portions 20*g*, 23*a* and the screw boss portions 22*a* are arranged at four places which are upper right, lower right, upper left and lower left.

A ring hook supporting body 27 supporting a ring hook 26 is attached between head portions of the bolts 24*a*, 24*a* on the upper side and the rear end portions of the bolt hole portions 20*g*. The ring hook supporting body 27 is an arc-shaped plate member extending in a right and left direction. The ring hook supporting body 27 has holes through which the bolts 24*a* pass at right and left both ends. The ring hook portion 27 also has a ring hook receiving portion 28 at the central lower part, which is recessed upward in a Ω-shape with respect to lower edges of both sides. Furthermore, the ring hook supporting body 27 has an elastic portion 30. The elastic portion 30 has a W-shape seen from the front direction (rear direction), which surrounds the ring hook receiving portion 28 and reaches the central part of an upper edge and the right and left thereof.

The ring hook 26 is inserted to the ring hook receiving portion 28. The ring hook 26 is a ring-shaped member made of a metal, which can be moved from a standing posture extending in front, rear, top and bottom directions to an inclined posture inclined left or right (until contacting an upper surface of the housing 2). The ring hook 26 can hold an arbitrary posture from the inclined posture to the left to the inclined posture to the right through the standing posture due to the elastic portion 30 arranged at the ring hook receiving portion 28 in the ring hook supporting body 27. Note that the impact wrench 1 can be hung by hanging the ring hook 26 on a rope or a hook installed on a wall and so on, and the ring hook 26 is naturally in the standing posture due to the weight acting on the impact wrench 1.

Moreover, a U-hook supporting body 34 supporting a U-hook 32 is attached to a rear portion (rear side of the air outlets 20*f*) of the right motor housing 20*b* by screws 36, 36.

The U-hook 32 includes a hook base portion 32*a* extending in the front and rear direction inserted into the U-hook supporting body 34, a bending portion 32*b* which is perpendicular to the hook base portion 32*a*, a hook end portion 32*c* extending in the front and rear direction and perpendicular to the bending portion 32*b* and a hook tip portion 32*d* arranged at a front end portion of the hook end portion 32*c*. One end of the bending portion 32*b* is connected to a rear end of the hook base portion 32*a* through a J-shaped corner portion, and the other end is connected to a front end of the hook end portion 32*c* in the same manner.

The U-shaped supporting body 34 has a hole extending in the front and rear direction, into which the hook base portion 32*a* of the U-hook 32 is inserted. In an inner surface of the hole, a not-shown cylinder of an elastic body is arranged. The U-hook supporting body 34 includes a cylindrical portion having the hole and a screw hole portion extending from the cylindrical portion to the left side, and the screws 36, 36 are inserted into the screw hole portion. A plate member 37 (see FIG. 12) on which screw holes are formed at front and rear portions is arranged under the screw hole portion inside the thick wall portion of the right motor housing 20*b*. The screw holes are female screw holes, into which the screws 36 as male screws are respectively inserted. The head portions of corresponding screws 36 are inserted into the screw holes of the U-hook supporting body 34.

As shown in FIG. 16 to FIG. 18, the hook end portion 32*c* of the U-hook 32 can be positioned in the upper side, the right side, the left side and the lower side of the U-hook supporting body 34, which can turn from the lower position (a position contacting a right surface of the housing 2) toward the left position through the right side and the upper side until reaching a position contacting a left surface of the housing 2 and which can be stopped at an arbitrary portion within the turning range.

The hook end portion 32*c* is positioned above an upper end of the ring hook 26 in the upper position, therefore, it is possible to select whether the ring hook 26 is used or the U-hook 32 in the upper position is used.

An interval from a right surface portion or a left surface portion of the housing 2 to the hook end portion 32*c* differs according to whether the hook end portion 32*c* is in the right side or in the left side. The interval can be relatively wide in the right side and can be relatively small in the left side, therefore, the U-hook 32 can be stably hung on the member having widths different from one another by using the position with the suitable interval.

Furthermore, when the hook end portion 32*c* is positioned in the lower position, the U-hook 32 is positioned in the left of the right surface portion (rightmost position) of the housing 2. Accordingly, the U-hook 32 can be housed so as to be along the outline of the impact wrench 1 (body portion 4) by arranging the U-hook 32 in the lower position, as a result, the U-shook 32 does not interfere at the time of using or carrying the impact wrench 1 without using the U-hook 32.

On the other hand, the housing 2 in the grip portion 6 is referred to as a grip housing 38.

Upper portions of the grip housing 38 has respectively half-split portions. The grip housing 38 includes a left grip housing 38*a* and a right grip housing 38*b*. The left grip housing 38*a* is formed integrally with the right motor housing 20*a* and the right grip housing 38*b* is integrally formed with the right motor housing 20*b*. The left grip housing 38*a*, the right grip housing 38*b*, the left motor housing 20*a* and the right motor housing 20*b* are combined by the screws 24, 24. In the left motor housing 20*a*, screw bosses 38*c*, 38*c* for the screws 24, 24 are formed.

A forward/reverse switch lever 40 as a switch for switching the rotation direction of the motor 10 is provided above the grip housing 38 and in the rear of the switch lever 8 so as to pierce in the right and left direction in a boundary region between the body portion 4 and the grip portion 6. Further, a light 42 which can irradiate the front is provided above the switch lever 8 and in front of the forward/reverse switch lever 40. The light 42 is a LED in this case, which is provided so as to overlap with the switch lever 8 in the vertical direction. As the light 42 is provided so as to overlap with the switch lever 8 in the vertical direction, a finger and the like of the user is not positioned in an irradiation direction of the light 42 and the interference of irradiation of the light 42 can be prevented. Thus, visibility of the light 42 is improved at the time of lighting.

In a lower part of the grip housing 38, a box-shaped battery holding housing 43 opening upward is arranged. The battery holding housing 43 extends mainly to the front with respect to the upper portion thereof. The battery holding housing 43 includes a left battery holding housing 43*a* and a right battery holding housing 43*b* which are respectively half-split portions. Screw bosses 43*c*, 43*c* are formed in the left battery holding housing 43*a*, and screw holes (not shown) corresponding to the screw bosses 43*c*, 43*c* are formed in the right battery holding housing 43*b*. The left battery holding housing 43*a* and the right battery holding housing 43*b* are combined by screws 24 inserted into the screw bosses 43*c* and the screw holes.

A lower end portion of the battery holding housing 43 is a battery attaching portion 44, and a battery 46 is held in a lower part of the battery attaching portion 44 so as to be detachable by a not-shown pressing bottom. The battery 46 is a lithium-ion battery of 18V in this case. The battery 46 can be attached to the battery attaching portion 44 by being slid from the front direction to the rear direction of the battery attaching portion 44.

A display portion 48 with a display switch (a display portion by an LED in this case) is provided in the upper front part of the battery holding housing 43. On the display portion 48 with the display switch, the rotation speed (four stages of the minimum, low, high and the maximum in this case) of the motor 10, the remaining amount of the battery 43 (three stages of low, middle and high in this case) are displayed.

A control circuit board 52 on which a capacitor 50 and so on are mounted is housed inside the battery holding housing 43 in a lower side of the display portion 48 with the display switch. The display portion 48 with the display switch is mounted on the control circuit board 52. The capacitor 50 is mounted so as to protrude upward, and an upper portion (major part other than a lower portion) enters lower end portions of the left grip housing 38*a* and the right grip housing 38*b*. The control circuit board 52 also controls display in the display portion 48 with the display switch. The control can be performed by a later-described microcomputer or a dedicated device.

The battery holding housing 43 is attached to the grip housing 38 by using two screws in a state where the lower end portions of the left grip housing 38*a* and the right grip housing 38*b* are received inside an opening at the upper part of the battery holding housing 43.

An elastic body 54 is interposed between the lower end portions of the grip housing 38 and the opening of the battery holding housing 43. That is, the lower end portions are connected to the opening through the elastic body 54. The elastic body 54 has a left elastic body 54*a* and a right elastic body 54*b* which are respectively sheet-shaped members with plural outer protrusions 54*c*. The elastic body 54 is arranged so as to be along the lower end portions opening to the outer side in the radial direction and the opening toward the inner side in the radial direction. The elastic body 54 has the left elastic body 54*a* arranged in the lower end portion and a left half (inner side of the left battery holding housing 43*a*) of the opening and the right elastic body 54*b* arranged in the lower end portion and a right half of the opening (inner side of a right battery holding housing 43*b*).

The motor housing 20 is connected to the grip housing 38, and they function as a first housing which houses the motor 10. The battery holding housing 43 functions as a second housing connecting to the first housing through the elastic body 54.

On the outer side to the lower side of the control circuit board 52, a case 55 made of a resin (an insulating material or an elastic material) having a flat box shape opening upward is arranged. The control circuit board 52 is held in the case 55 in a state where the upper side thereof is exposed, and the case 55 is held in the battery holding housing 43. The control circuit board 52 is fixed by a structure (for example, molding) closely adhering to the case 55. As the control circuit board 52 is held by the case 55, a short circuit, a device failure and so on can be prevented by increasing the insulating performance and furthermore, dust or moisture is prevented from flowing in and adhering to the control circuit board 52, which can prevent failures and so on. Additionally, as the control circuit board 52 is held by the battery holding housing 43 through the case 55, even when vibration is slightly transmitted to the control circuit board 52 through a vibration control effect by the elastic body 54, the vibration is further reduced by the case 55.

The motor 10 is the brushless DC motor belonging to an inner rotor type including a stator 56 and a rotor 58.

The stator 56 includes a stator core 60, a front insulating member 62 and a rear insulating member 64 provided in front and rear of the stator core 60 and plural (six in this case) drive coils 66, 66 respectively wound around the stator core 60 through the front insulating member 62 and the rear insulating member 64. A sensor circuit board 68 is fixed to the rear insulating member 64, and a short-circuiting member 69 including plural (three) arc-shaped sheet metal members (a first sheet metal member 69*a*, a second sheet metal member 69*b* and a third sheet metal member 69*c*) are fixed to the rear side of the sensor circuit board 68. The first sheet metal member 69*a* electrically connects two drive coils 66, 66 which face each other. The second sheet metal member 69*b* electrically connects another two drive coils 66, 66 which face each other. The third sheet metal member 69*c* electrically connects further another two drive coils 66, 66 which face each other.

The rotor 58 is arranged inside the stator 56. The rotor 58 includes a rotor shaft 70 as a motor shaft, a cylindrical rotor core 72 arranged around the rotor shaft 70, plural (four) plate-shaped permanent magnets 74 arranged in the outer side of the rotor core 72, polarities of which are alternately changed and plural permanent magnets for the sensor (not shown) arranged radially in the rear side (sensor circuit board 68 side) of the permanent magnets 74. A front end portion of the rotor shaft 70 is formed as a pinion gear portion 75 having outer teeth. The rotor core 72, the permanent magnets 74 and the permanent magnets for the sensor configure a rotor assembly.

Not-shown plural (three) sensors detecting a rotation angle (rotation position) of the rotor 58 (rotor shaft 70) by the permanent magnets for the sensor are mounted on the sensor circuit substrate 68. The sensor circuit substrate 68 is electrically connected to the control circuit board 52 inside the battery holding housing 43 by a not-shown lead wire. The control circuit board 52 has six switching devices (not shown). The switching devices are provided so as to correspond to some of the drive coils 66, performing switching of corresponding drive coils 66. The control circuit board 52 has a not-shown microcomputer, and the microcomputer controls switching of the above switching devices. The control circuit board 52 is a controller for controlling the motor 10.

A bearing 76 positioned in a front portion of the rotor shaft 70 is provided frontward of the rotor core 72. The bearing 76 is held by the bearing retainer 25 fixed to the rear portion of the gear housing 23, and held by the gear housing 23 through the bearing retainer 25. The bearing 76 is arranged on a straight line connecting respective center of the screw 24 in the upper part of the body portion 4 and the screw 24 in (the center of) the lower part of the body portion 4. Therefore, the vibration of the rotor shaft 70 can be effectively suppressed.

A fan 78 for cooling is arranged between the bearing 76 in front of the rotor shaft 70 and the rotor core 72. The fan 78 is fixed to the rotor shaft 70. The air outlets 20*f*, 20*f* . . . are positioned outside the fan 78 in the radial direction, and wind of the fan 78 is discharged effectively.

A bearing 80 positioned in a rear end of the rotor shaft 70 is provided rearward of the rotor core 72. The bearing 80 is fixed inside the rear end portion of the motor housing 20.

The spindle 14 has a hollow disc-shaped portion 82 at a rear portion thereof. The disc-shaped portion 82 and has a longer diameter than other portions and protrudes outward with respect to other portions of the spindle 14.

A washer 84 is fixed to the front side of the disc-shaped portion 82.

In the disc-shaped portion 82 of the spindle 14, part of the planetary gear mechanism 12 and a tip end portion of the rotor shaft 70 are arranged.

The planetary gear mechanism 12 has the gear housing 23 as the outline, including an internal tooth gear 86 fixed inside the opening in the front portion of the gear housing 23 by the spline structure, plural (three) planetary gears 88, 88 . . . having outer teeth in respective stages of front and rear two stages, plural (three) shafts 90, 90 as shafts of the planetary gears 88, 88 and pins 91, 91 which respectively extend in the right and left direction and are arranged in upper and lower parts for restricting an internal tooth gear 86 so as not to move forward.

In the inner side of the opening in the front part of the gear housing 23, spline grooves 23*c*, 23*c* are formed in the front and rear direction. In an outer surface of the internal tooth gear 86, spline projections 86*a*, 86*a* corresponding to the spline grooves 23*c*, 23*c* are formed. As the spline projections 86*a*, 86*a* are fitted to the spline grooves 23*c*, 23*c*, the internal tooth gear 86 can be prevented from rotating with respect to the gear housing 23.

A rear stage 88*a* (first planetary gear) of each planetary gear 88 is integrally formed with a front stage 88*b* (second planetary gear) 88. The rear stage 88*a* of each planetary gear 88 is coaxial with and has a larger diameter than the front stage 88*b* of the planetary gear 88. The number of teeth of the rear stage 88*a* of each planetary gear 88 is larger than the number of teeth of the front stage 88*b* of each planetary gear 88.

Outer teeth of the rear stage 88*a* of each planetary gear 88 are engaged with the teeth of the pinion gear portion 75 at the tip of the rotor shaft 70. Outer teeth of the front stage 88*b* of each planetary gear 88 are engaged with the internal tooth gear 86. In FIG. 6 to FIG. 8, these teeth are not shown separately, and are schematically shown as circles connecting outer diameters (tips of teeth).

As shown in FIG. 6, pin receiving portions 23*d*, 23*d* receiving the pins 91 are formed in the upper part and the lower part of the gear housing 23. Each pin receiving portion 23*d* includes a hole extending in the right and left direction through which the pin 91 is inserted, and right-and-left vertical small wall portions as right and left end portions of the hole. Horizontal small wall portions are formed in the outer side of lower end portions of the vertical small wall portions. In order to form the vertical small wall portions and the horizontal small wall portions in the cylindrical gear housing 23, the outer surface of the gear housing 23 is recessed inward with respect to the cylindrical surface at right and left of each pin receiving portion 23*d*.

One shaft 90 extending in the front and rear direction is inserted into the center of one planetary gear 88. Each shaft 90 is laid inside the disc-shaped portion 82 (between the front wall and the rear wall of the disc-shaped portion 82) of the spindle 14, rotatably supporting the planetary gear 88 around the shaft. That is, the spindle 14 having the disc-shaped portion 82 holds the planetary gears 88, 88 through the shaft 90, 90.

Respective holes on the front wall of the disc-shaped 82 into which the shafts 90, 90 are inserted are closed by one washer 84. A rear portion of the washer 84 is arranged inside the front opening of the gear housing 23.

The washer 84 receives a rear end of the spring 15 which is formed in a ring shape in the vicinity of a front surface.

The planetary gear mechanism 12 can be assembled to the front part of the motor housing 20 as described below.

First, the gear housing 23 containing the bearing 76 and the bearing retainer 25 is arranged around the tip portion (pinion gear portion 75) of the rotor shaft 70. At this time, as illustrated in each drawing, a rear surface of the gear housing 23 meets an inner surface of the front opening of the motor housing 20.

Next, the planetary gears 88, 88 are inserted into the disc-shaped portion 82 of the spindle 14 through the shafts 90, 90, and the spindle 14 is drawn back until the rear end of the spindle 14 contacts the bearing retainer 25. The disc-shaped portion 82 is positioned inside the gear housing 23, and the rear stages 88*a* of the planetary gears 88, 88 are engaged with the pinion gear portion 75.

Subsequently, the internal tooth gear 86 is slid backward along the spline grooves inside the front opening of the gear housing 23, and the rear surface of the internal tooth gear 86 is allowed to contact a ring-shaped vertical plane inside the front opening of the gear housing 23. The vertical plane is formed as a diameter of the rear side is smaller than a diameter of the front side. The front stages 88*b* of the planetary gears 88, 88 are engaged with the internal tooth gear 86.

Furthermore, the pins 91, 91 are inserted into the pin receiving portions 23*d*, 23*d* to fix the internal tooth gear 86. Here, end portions of each of the pin receiving portions 23*d*, 23*d* are vertical small walls (flat surfaces), and horizontal small walls (flat surfaces) are arranged outside the lower ends of the vertical small walls. Therefore, the pins 91, 91 are hardly caught by the gear housing 23 when the pins 91, 91 are inserted into the pin receiving portions 23*d*, 23*d*, which facilitates the insertion of the pins 91, 91.

Then, the washer 84 is fitted to the front side of the front wall of the disc-shaped portion 82 of the spindle 14.

The hammer 16 has a recess 92 which is recessed from a rear surface to the front direction, and a front portion of the spring 15 is housed in the recess 92. In the bottom (front end) of the recess 92, a ring-shaped front end of the spring 15 is arranged through plural balls 94, 94 and a hammer washer 96.

Balls 98, 98 guiding the hammer 16 mainly in the front and rear direction at the time of impacting are interposed between the hammer 16 and the front portion of the spindle 14.

In the impact wrench 1, an impact mechanism is configured by the hammer 16, the balls 94, 94, the hammer washer 96 and the balls 98, 98 (as well as the spring 15). The hammer 16 can be regarded as the impact mechanism.

The anvil 18 positioned in front of the hammer 16 has a pair of extending portions 100, 100 respectively extending in the radial direction.

In the front side of the extending portions 100, 100, an anvil ring 102 is provided to support the anvil 18 around the axis rotatably and so as not to be displaced in the axial direction. The anvil ring 102 is attached to a front inner wall of the hammer case 22.

In the front side of the anvil ring 102, a metal bearing 103 is provided to rotatably support the anvil 18 around the axis. The metal bearing 103 is attached to the front inner wall of the hammer case 22.

Moreover, in the center of a rear portion of the anvil 18, a rear hole 104 is opened as a hole extending from a rear surface to the front, and a front end portion of the spindle 14 is inserted into the rear hole 104 in a state where the rotational impact force can be transmitted.

On the other hand, a bit attaching portion 106 receiving a not-shown bit (tip tool) is provided in the front portion of the anvil 18.

An operation example of an impact wrench 1 will be explained.

When an operator grasps the grip portion 6 (grip housing 38) and pulls the switch lever 8, the power is supplied from the battery 46 to the motor 10 by switching in the switch body portion 9, thereby rotating the rotor shaft 70.

The fan 78 is rotated by the rotation of the rotor shaft 70, and the air flow is formed from the air inlets 20*c*, 20*c* to the air outlets 20*f*, 20*f*. At this time, the entire surface of the sensor circuit board 68 is cooled first by the air flow. Next, inner peripheries of the rotor core 72, the respective drive coils 66 and the stator core 60 are cooled.

The rotational force of the rotor shaft 70 is transmitted to the spindle 14 while being decelerated by the planetary gear mechanism 12.

The spindle 14 rotates the anvil 18 as well as guides the hammer 16 so as to swing (impact) in the front and rear direction when receiving a torque higher than or equal to a given threshold value in the anvil 18. A shock absorbing effect by the spring 15 acts on the hammer 16 (or the spindle 14).

Even when vibration is generated in the impact wrench 1 by the addition of the rotational force or the impact in the operation, it is possible to suppress the transmission of vibration with respect to the battery holding housing 43 which is connected to the motor housing 20 housing the motor 10 and the hammer 16 as generation sources of vibration and the grip housing 38 by sandwiching the elastic body 54 therebetween because the vibration is absorbed by the elastic body 54.

The planetary gears 88, 88 running while rotating around its axis inside the internal tooth gear 86 by the rotational force of the rotor shaft 70 transmit the rotational force to the spindle 14 through the shafts 90, 90, thereby performing deceleration in the planetary gear mechanism 12.

The rotational force of the rotor shaft 70 is transmitted to the rear stages 88*a* of respective planetary gears 88 through the pinion gear portion 75, and the front stages 88*b* having the smaller number of teeth than those of the rear stages 88*b* of respective planetary gear 88 run while rotating around their axes inside the internal tooth gear 86. Accordingly, the gear ratio is changed to the one with a higher reduction as compared with a case where a normal (one stage) planetary gear not including the front stage 88*b* and the rear stage 88*a* is used. It is possible to obtain the gear ratio with the higher reduction also when two normal planetary gears are respectively engaged and aligned inside the internal tooth gear in the radial direction. However, the planetary gear mechanism 12 can be reduced in size (particularly the size in the radial direction, namely, an outer diameter) as compared with the above case.

When citing the planetary gear mechanism 12 as a specific example, in which the number of teeth of the pinion gear portion 75 (sun gear) is 6, the number of teeth of the rear stage 88*a* (first planetary gear) of each planetary gear 88 (planetary gear) is 24, the number of teeth of the front stage 88*b* (second planetary gear) of each planetary gear 88 is 11 and the number of teeth of the internal tooth gear 86 (internal gear) is 41, the gear ratio is approximately 15.9:1. The gear ratio is the same as a gear ratio in a case (Comparative example 1) where the number of teeth of the sun gear is 6, the number of teeth of the planetary gear is 42 and the number of teeth of the internal gear is 89 in the normal planetary gear mechanism. However, the size (outer diameter) is relatively large for securing the number of teeth of the internal gear in the planetary gear mechanism of Comparative example 1). In a case (Comparative example 2) where the number of teeth of the sun gear is 6, the number of teeth of the planetary gear is 18 and the number of teeth of the internal gear is 41 in the normal planetary gear mechanism, the gear ratio is approximately 7.83:1, the planetary gear mechanism 12 can further perform deceleration as compared with Comparative example 2.

In the case where the gear ratio can be set to approximately 15.9:1 (12:1 or more to 18:1 or less as a preferable range) as in the specific example of the planetary gear mechanism 12, the rotation of the rotor shaft 70 can be sufficiently decelerated and a desired torque can be obtained even when applying the brushless motor 10 having a lower torque and a higher rotation speed (for example, approximately 24000 rotations/minute (rpm), 20000 rpm or more to 30000 rpm or less) as compared with a brush motor having equivalent output. Additionally, the mechanism can be compact in size as compared with related art in the same manner as the brushless motor 10.

The impact wrench 1 described above includes the motor 10 having the rotor shaft 70, the pinion gear portion 75 rotated by the rotor shaft 70, the rear stages 88*a* of the planetary gears 88, 88 engaged with the pinion gear 75, the front stages 88*b* of the planetary gears 88, 88 fixed to the rear stages 88*a* and rotated with the rear stages 88*a*, the internal tooth gear 86 engaged with the front stages 88*b*, the spindle 14 (disc-shaped portion 82) holding the front stages 88*b* and the rear stages 88*a* of the planetary gears 88, 88 and the anvil 18 connecting to the spindle 14. Accordingly, the rotational force with respect to the pinion gear portion 75 given by the motor 10 can be sufficiently decelerated with respect to the spindle 14 by the internal tooth gear 86 or the front stages 88*b* and the rear stages 88*a* of the planetary gears 88, 88 while the size of the internal tooth gear 86 is reduced.

Moreover, the impact wrench 1 includes the motor 10 having the rotor shaft 70, the motor housing 20 housing the motor 10, the gear housing 23 fixed to the motor housing 20, the bearing 76 held by the gear housing 23, the pinion gear portion 75 rotated by the rotor shaft 70, the rear stages 88*a* of the planetary gears 88, 88 engaged with the pinion gear 75, the front stages 88*a* of the planetary gears 88, 88 fixed to the rear stages 88*a* and rotating with the rear stages 88*a*, the internal tooth gear 86 engaged with the front stages 88*b*, the spindle 14 (disc-shaped portion 82) holding the front stages 88*b* and the rear stages 88*a* of the planetary gears 88, 88, and the anvil 18 connecting to the spindle 14. Accordingly, the rotational force with respect to the pinion gear portion 75 given by the motor 10 can be sufficiently decelerated with respect to the spindle 14 by the internal tooth gear 86 or the front stages 88*b* and the rear stages 88*a* of the planetary gears 88, 88 while the sizes of the internal tooth gear 86 and the gear housing 23 are reduced.

Furthermore, the rear stages 88*a* of the planetary gears 88, 88 are fixed to the side (rear side of the front stages 88) close to the motor 10 in the front stages 88*b*. Therefore, the rear stages 88*a* engaged with the pinion gear portion 75 of the rotor shaft 70 are arranged in the rotor 10 side, and the front stages 88*b* engaged with the internal tooth gear 86 can be arranged to the anvil 18 side (spindle 14 side), which makes a simple structure corresponding to the transmission direction of the rotational force.

Additionally, the impact mechanism (hammer 16) which impacts on the anvil 18 is included. Accordingly, the compact rotary impact tool having the sufficient gear ratio can be provided.

Furthermore, the impact wrench 1 described above includes the motor housing 20 housing the motor 10 or the grip housing 38, the battery holding housing 43 connecting to the motor housing 20 or the grip housing 38 through the elastic body 54 and the control circuit board 52 for controlling the motor 10, which is housed in the battery holding housing 43.

Furthermore, the impact wrench 1 described above includes the motor housing 20 housing the motor 10, the grip housing 38 extending downward from the motor housing 20, the battery holding housing 43 connecting to the grip housing 38 through the elastic body 54, and the control circuit board 52 housed in the battery holding housing 43 for controlling the motor 10.

Accordingly, if the rotary impact mechanism driven by the motor 10 generates vibration, the vibration can be suppressed to transmit to the control circuit board 52 for controlling the motor 10 from the grip housing 38 and the motor housing 20 which houses the rotary impact mechanism. For example, even when the rotary impact mechanism capable of outputting a torque of 700 Nm (newton-meter) or more to 1000 Nm or less generates vibration, vibration is hardly transmitted or the battery holding housing 43 to the control circuit board 52 by the shock absorbing effect of the elastic body 54. Accordingly, it is possible to protect the control circuit board 52 for controlling the motor 10 on which various devices are mounted from the vibration, which suppresses occurrence of failure and extends the lifetime. It is also possible to protect other members (for example, a contact point with respect to the battery 46 in the battery attaching portion 44) attached to or housed in the battery holding housing 43 from the vibration.

Furthermore, the impact wrench 1 described above includes the motor housing 20 housing the motor 10 or the grip housing 38, the battery holding housing 43 connecting to the motor housing 20 or the grip housing 38 through the elastic body 54, and the display portion 48 which is provided in the battery holding housing 43 and includes the display switch displaying the state concerning the motor 10 or the battery 46. Accordingly, it is possible to protect the display portion 48 with the display switch from the vibration.

Moreover, the control circuit board 52 is held through the case 55 made of a resin. Accordingly, the vibration can be further prevented by the case 55 and the control circuit board 52 can be protected from moisture and/or dust, which can further increase the insulating performance with respect to the control circuit board 52.

Additionally, the control circuit board 52 includes the capacitor 50 which is arranged in the central part of in the right and left direction of the control circuit board 52. Therefore, the capacitor 50 can be easily arranged inside the housing 2 and the control circuit board 52 can be further easily housed.

Furthermore, the impact mechanism (hammer 16) which impacts on the anvil 18 is included. Accordingly, it is possible to provide a rotary impact tool capable of suppressing transmission of vibration with respect to the control circuit board 52 for controlling the motor 10.

[Second Embodiment]

Figure 19:
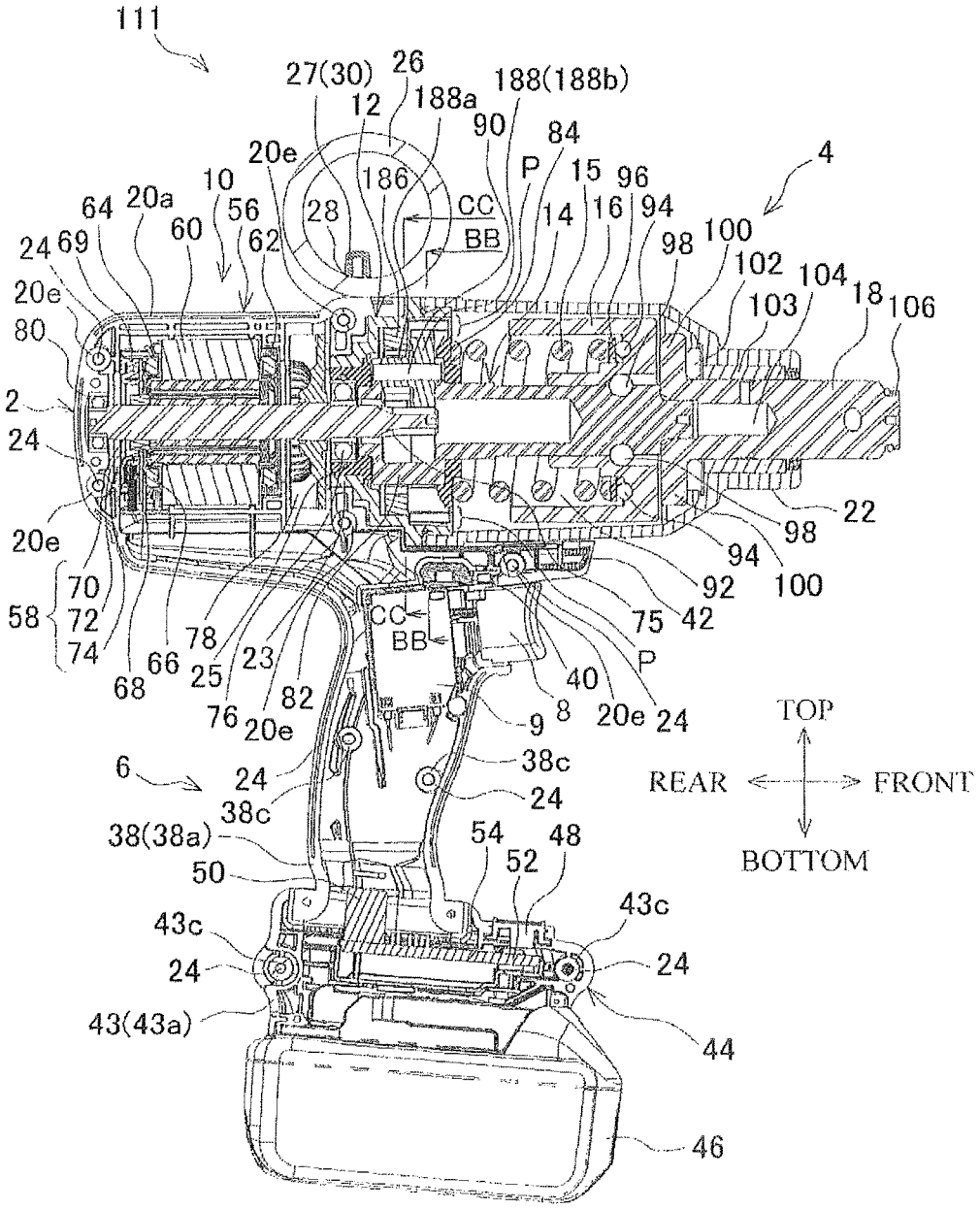
FIG. 19 is a view of an impact wrench according to a second embodiment of the present invention corresponding to FIG. 1.
Figure 20:
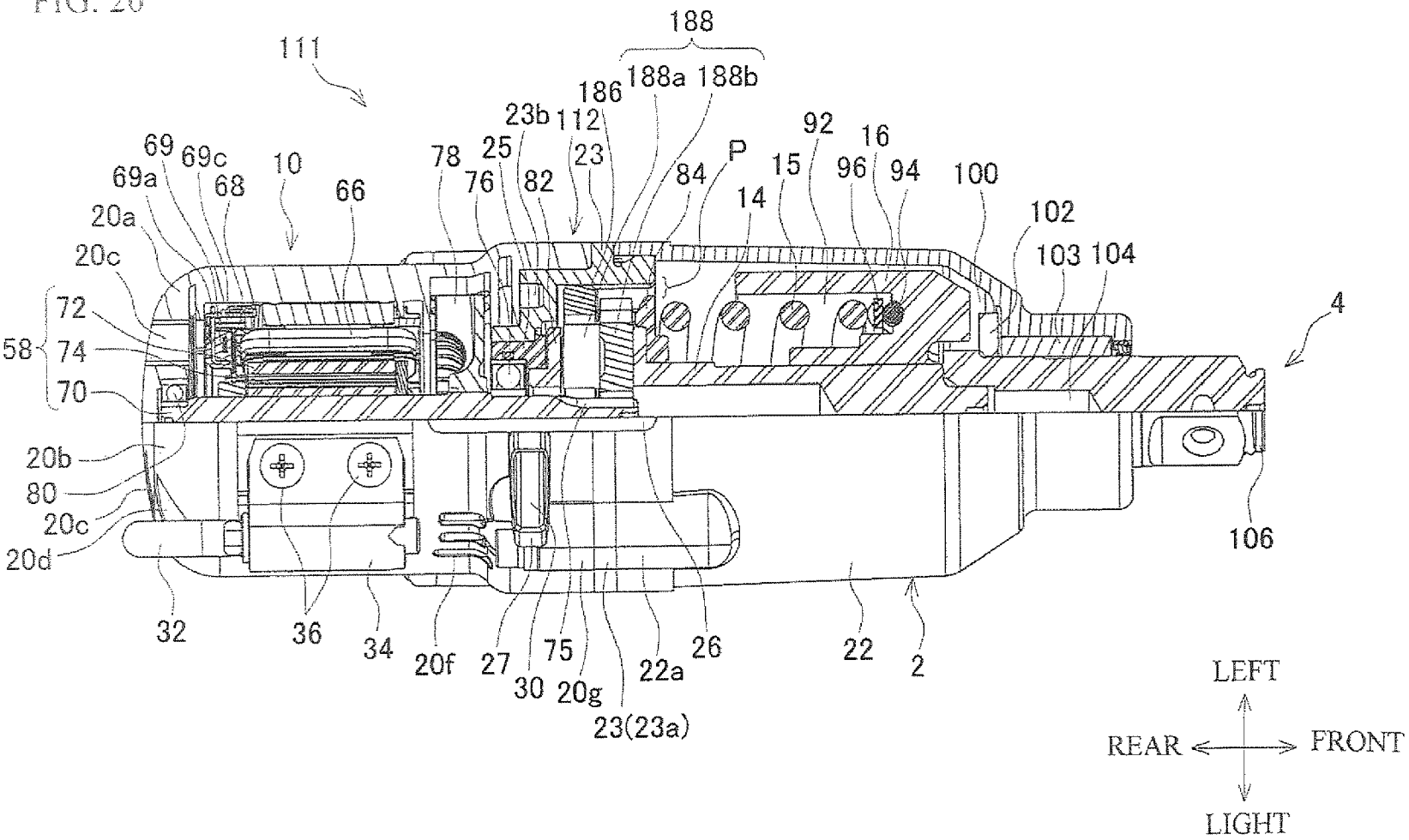
FIG. 20 is a view of the impact wrench according to the second embodiment of the present invention corresponding to FIG. 4.
Figure 21:
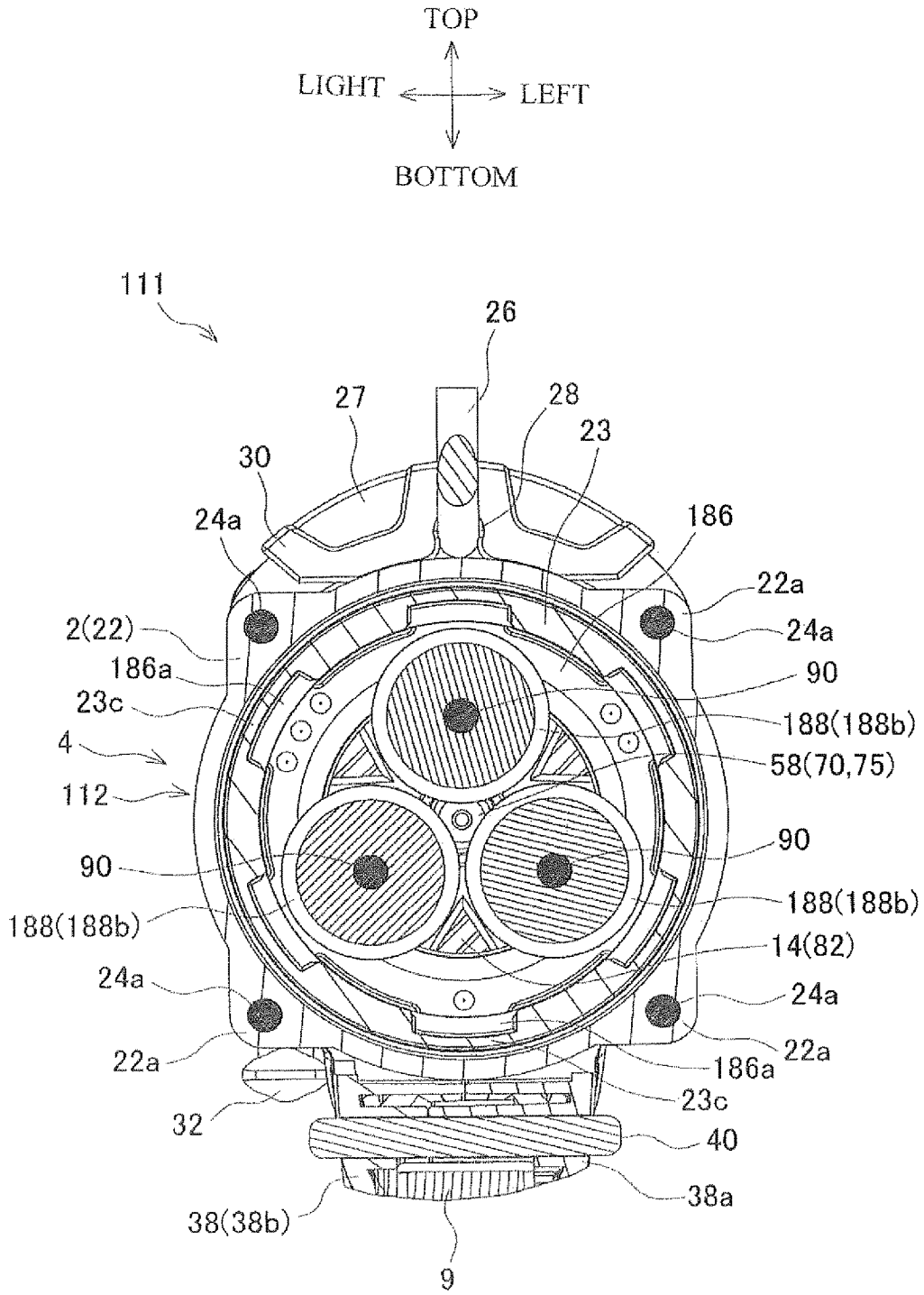
FIG. 21 is a view of the impact wrench according to the second embodiment of the present invention corresponding to FIG. 7 (a cross sectional view taken along BB-BB line of FIG. 19).
Figure 22:
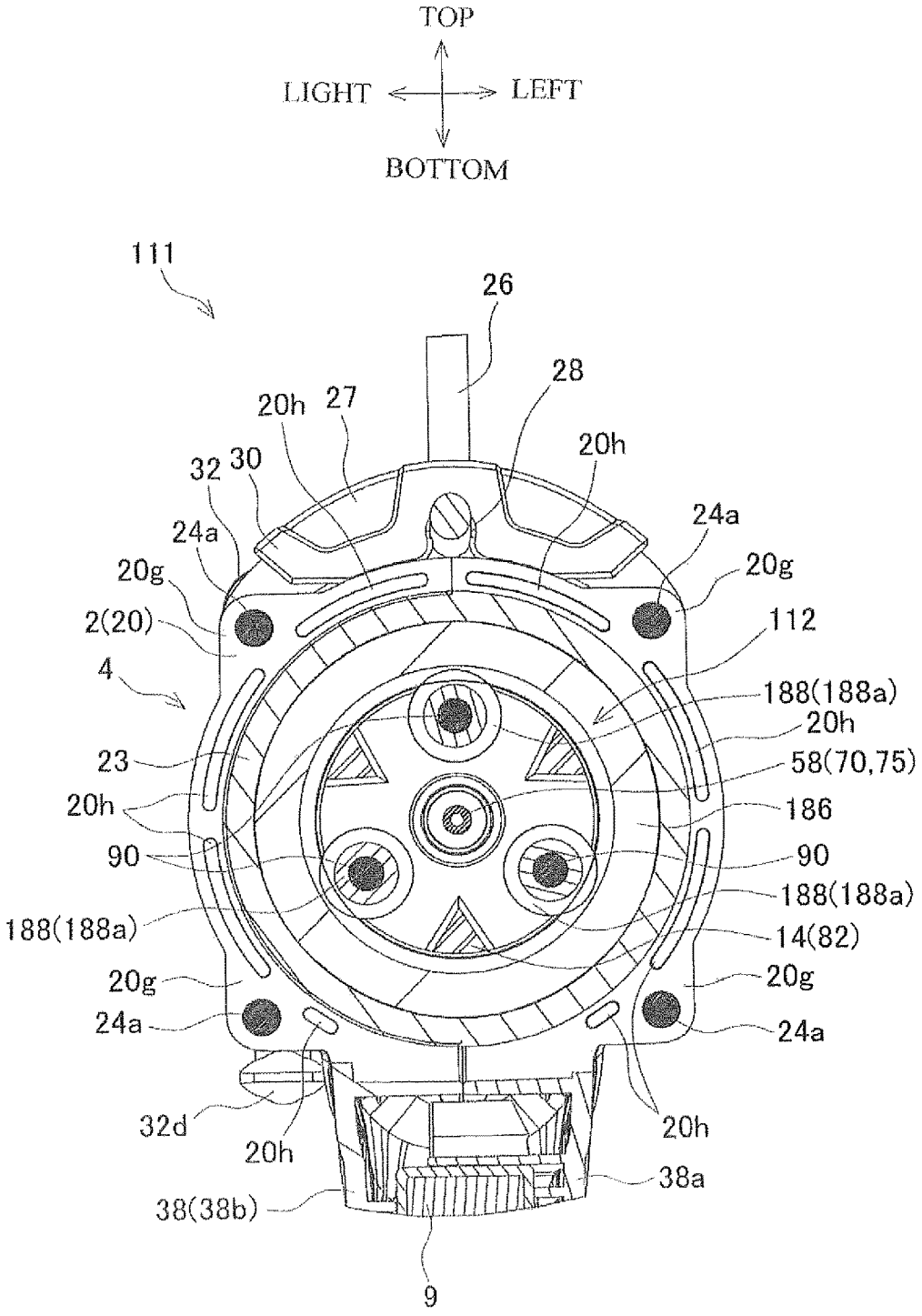
FIG. 22 is a view of the impact wrench according to the second embodiment of the present invention corresponding to FIG. 8 (a cross sectional view taken along CC-CC line of FIG. 19).
Figure 23:
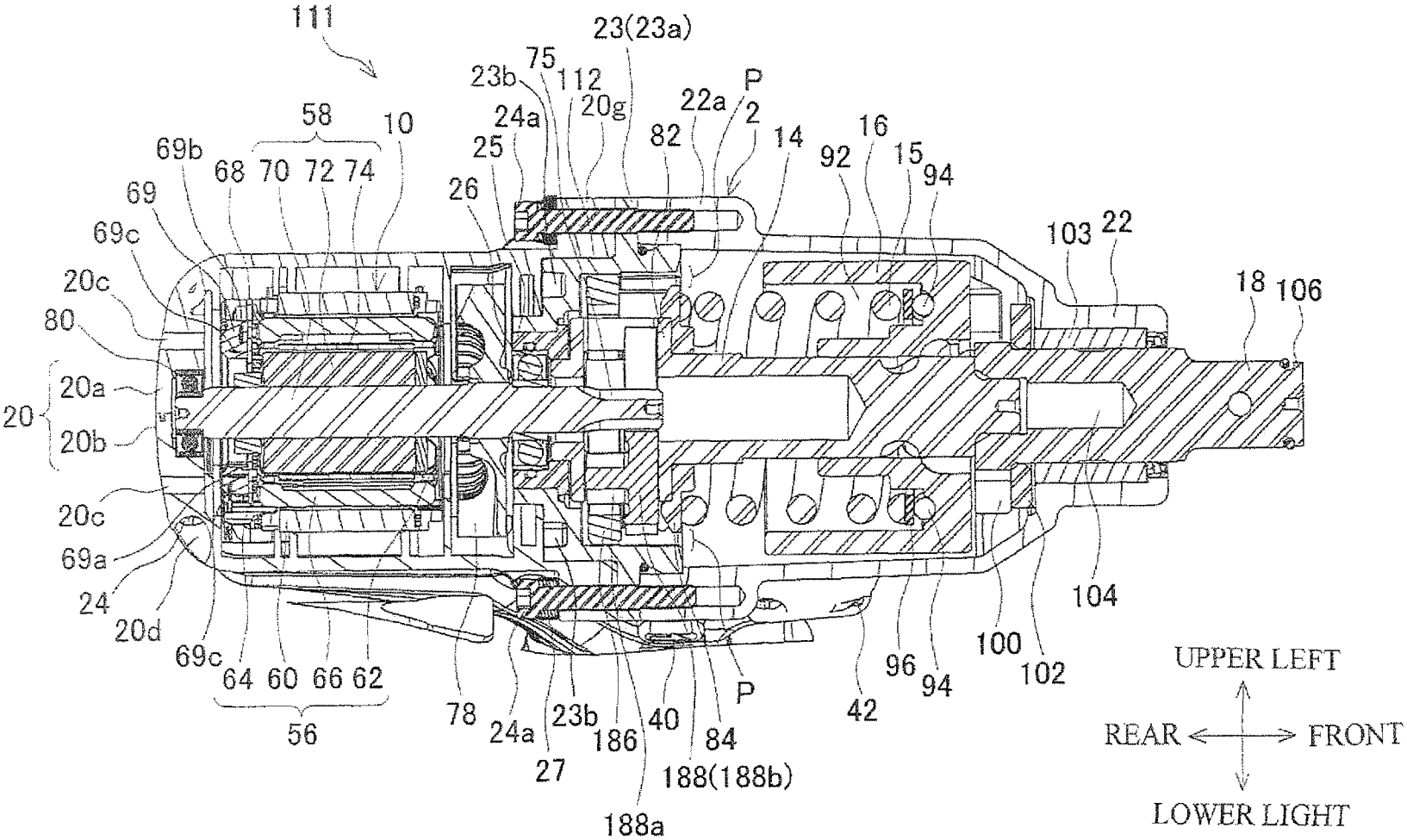
FIG. 23 is a view of the impact wrench according to the second embodiment of the present invention corresponding to FIG. 13.

FIG. 19 is a view of an impact wrench 111 according to a second embodiment of the present invention corresponding to FIG. 1. FIG. 20 is a view of the impact wrench 111 corresponding to FIG. 4. FIG. 21 is a view of the impact wrench 111 corresponding to FIG. 7 (a cross-sectional view taken along BB-BB line of FIG. 19). FIG. 22 is a view of the impact wrench 111 corresponding to FIG. 8 (a cross-sectional view taken along CC-CC line of FIG. 19). FIG. 23 is a view of the impact wrench 111 corresponding to FIG. 13.

The impact wrench 111 according to the second embodiment has the same structure as the impact wrench 1 according to the first embodiment except for the planetary gear mechanism. The same symbols are given to the same members and portions having the same structures as the impact wrench 1, and the explanation thereof is omitted appropriately.

A planetary gear mechanism 112 of the impact wrench 111 has the same structure as the planetary gear mechanism 12 of the impact wrench 10 except for the planetary gears, the internal tooth gear and the pins.

Each of respective planetary gears 188 (three in total) of the planetary gear mechanism 112 has a front stage 188*b* and a rear stage 188*a* which are coaxial with each other and each having outer teeth. The front stage 188*b* has a larger diameter than the rear stage 188*a* and the number of teeth of the front stage 188*b* is larger than those of the rear stage 188*a*. A shaft 90 is inserted in a position of the central axis of each planetary gear 188 in the front and rear direction.

The pinion gear portion 75 of the rotor shaft 70 of the motor 10 reaches the front stages 188*b* of respective planetary gears 188, which is engaged with the front stages 188*b* (first planetary gears).

An internal tooth gear 186 of the planetary gear mechanism 112 is engaged with the rear stages 188*a* (second planetary gears) of respective planetary gears 188. The internal tooth gear 186 is positioned backward as compared with the internal tooth gear 86 according to the first embodiment, and inserted to the inside seen from the front opening of the gear housing 23. The internal tooth gear 186 has spline projections 186*a*, 186*a* . . . in the same manner as the internal tooth gear 86, which is fixed to the gear housing 23 by the spline structure.

As the housing 2 having the same shape as that of the impact wrench 1 is used in the impact wrench 111, a space P is formed in the outer side in the radial direction of the front stages 188*b* of respective planetary gears 188. The space P can be filled by changing the shape of the housing 2 (particularly the gear housing 23) so as to be closer to the inner side in the radial direction. The shape is changed so as to be closer to the inner side while keeping the thickness of the housing 2 in the same degree, thereby further reducing the size (particularly in the radial direction) while maintaining the rigidity of the impact wrench 111.

The planetary gear mechanism 112 can be assembled with respect to the front portion of the motor housing 20 as follows.

First, the gear housing 23 containing the bearing 76 and the bearing retainer 25 is arranged around the front portion of the rotor shaft 70.

Next, the internal tooth gear 186 is slid backward so as to be along spline grooves of the gear housing 23 so that a rear surface of the internal tooth gear 186 contacts a ring-shaped vertical surface (the second ring-shaped vertical surface counted from the front opening) inside the front opening of the gear housing 23. The vertical surface is formed as a diameter of the rear side is smaller than a diameter of the front side. Note that pins for restricting the movement of the internal tooth gear 186 are not provided in the planetary gear mechanism 112.

Subsequently, the planetary gears 188, 188 are inserted into the disc-shaped portion 82 of the spindle 14 through the shafts 90, 90, and the spindle 14 is drawn back until the rear end of the spindle 14 touches the bearing retainer 25. The disc-shaped portion 82 is positioned inside the gear housing 23, and the rear stages 188*a* of the planetary gears 188, 188 are engaged with the internal tooth gear 186. The front stages 188*b* of the planetary gears 188, 188 are engaged with the pinion gear portion 75.

Then, the washer 84 is fitted to the front side of the front wall of the disc-shaped portion 82 of the spindle 14.

The above impact wrench 111 is operated in the same manner as the impact wrench 1 according to the first embodiment.

The front stages 188*b* of respective planetary gears 188 take a role as the first planetary gears engaged with the pinion gear portion 75 of the rotor shaft 70. The rear stages 188*a* of the respective planetary gears 188 take a role as the second planetary gears engaged with the internal tooth gear 186.

The impact wrench 111 described above includes the motor 10 having the rotor shaft 70, the pinion gear portion 75 rotated by the rotor shaft 70, the front stages 188*b* of the planetary gears 188, 188 engaged with the pinion gear 75, the rear stages 188*a* of the planetary gears 188, 188 fixed to the front stages 188*b* and rotating with the front stages 188*b*, the internal tooth gear 186 engaged with the rear stages 188*a*, the spindle 14 (disc-shaped portion 82) holding the front stages 188*b* and the rear stages 188*a* of the planetary gears 188, 188 and the anvil 18 connecting to the spindle 14. Accordingly, the rotational force with respect to the pinion gear portion 75 can be sufficiently decelerated with respect to the spindle 14 by the internal tooth gear 186 or the front stages 188*b* and the rear stages 188*a* of the planetary gears 188, 188 while the size of the internal tooth gear 186 is reduced.

Moreover, the impact wrench 1 includes the motor 10 having the rotor shaft 70, the motor housing 20 housing the motor 10, the gear housing 23 fixed to the motor housing 20, the bearing 76 held by the gear housing 23, the pinion gear portion 75 rotated by the rotor shaft 70, the front stages 188*b* of the planetary gears 188, 188 engaged with the pinion gear 75, the rear stages 188*a* of the planetary gears 188, 188 fixed to the front stages 188*b* and rotating with the front stages

188*b*, the internal tooth gear 186 engaged with the rear stages 188*a*, the spindle 14 (disc-shaped portion 82) holding the front stages 188*b* and the rear stages 188*a* of the planetary gears 188, 188, and the anvil 18 connecting to the spindle 14. Accordingly, the rotational force with respect to the pinion gear portion 75 can be sufficiently decelerated with respect to the spindle 14 by the internal tooth gear 186 or the front stages 188*b* and the rear stages 188*a* of the planetary gears 188, 188 while the sizes of the internal tooth gear 186 and the gear housing 23 are reduced.

The front stages 188*b* of the planetary gears 188, 188 are fixed to the side (the front side of the rear stages 188*a*) close to the anvil 18 (spindle 14) in the rear stages 188*a*. Accordingly, the front stages 188*b* engaged with the pinion gear portion 75 are arranged in the anvil 18 side. The rear stages 188*a* engaged with the internal tooth gear 186 can be arranged in the motor 10 side. The internal tooth gear 186 is arranged in the motor 10 side and the space P can be formed in the front side thereof, and other members are arranged in the space P, thereby further reducing the size.

Additionally, the impact mechanism (hammer 16) which impacts on the anvil 18 is included. Accordingly, the compact rotary impact tool having the sufficient gear ratio can be provided.

[Modification Examples]

The present invention is not limited to the above embodiments, and for example, the following modifications can be made appropriately.

In the planetary mechanism, it is also preferable that the first planetary gear engaged with the pinion gear portion and the second planetary gear engaged with the inter tooth gear are not integrally formed as the front stage and the rear stage of one planetary gear and that the first planetary gear and the second planetary gear are formed separately to be fixed to each other.

It is also preferable that the pinion gear portion is not provided integrally with the rotor shaft by forming the tip end portion of the rotor shaft in the gear shape and that a separate pinion gear is attached to the tip end portion of the rotor shaft.

The battery holding housing may be inserted into the grip housing and the elastic body may be interposed therebetween. It is also preferable to interpose the elastic body between the motor housing and the grip housing. Further, in this case, the vibration transmitted from the motor housing which houses the motor as the vibration source can be absorbed by the elastic body, and the vibration reaching the battery holding housing which houses the control circuit board for controlling the motor can be suppressed.

In the above embodiments, six switching devices are arranged on the control circuit board arranged inside the battery holding housing. However, six switching devices may be arranged on the sensor board. Other devices and the like can be mounted on the control circuit board or the sensor board, or on both boards. Moreover, the fan may be arranged in the rear part of the rear insulating member and the sensor board may be fixed to the front insulating member in a state of being arranged in the front part of the front insulating member. The brush motor may be applied as the motor.

As the battery, arbitrary lithium ion batteries of 18 to 36V such as 14.4V (20V at the maximum), 25.2V, 28V and 36V may be used, lithium ion batteries having a voltage lower than 14.4V or exceeding 36V may also be used, and other types of batteries can be used. It is further preferable that the power is supplied by a cord connected to the power source instead of power feeding by the battery.

The permanent magnets and the permanent magnets for the sensor in the rotor assembly can be a ring-shaped permanent magnet by forming the magnets integrally.

A gear case can be applied instead of using the hammer case, and the tip tool holding portion holding the tip tool may be fixed to the front portion of the output shaft by omitting the hammer and the anvil, thereby forming a rechargeable driver drill or a vibration driver drill.

The number, arrangement, material, size, type and so on of various members may be properly changed such that the number of sections in the housing is increased/decreased, for example, the gear housing and the motor housing are integrated, the grip housing and the motor housing are separated, the battery holding housing is split into two and so on. The setting number of various gears is increased/decreased, the type of the switch of the switching lever is changed, the bearing retainer is omitted and the bearing is directly fixed to the gear housing, the bearing retainers are doubly interposed, the elastic body arranged between the battery holding housing and the grip housing is provided in front and rear parts instead of separating the elastic body in right and left parts as well as three of more elastic bodies are provided, the display switch of the display portion with the display switch is not provided, the display contents of the display portion with the display switch includes matters other than the rotation speed concerning the motor, matters other than the remaining amount concerning the battery or other matters concerning the power tool.

The planetary gear mechanism according to the present invention may be applied to power tools other than the impact wrench, which perform deceleration, for example, can be applied to a driver drill, a shear wrench and so on.

Furthermore, the vibration control mechanism configured by interposing the elastic body between the battery holding housing in which the control circuit board is arranged and the grip housing can be applied to power tools other than the impact wrench, for example, can be applied to a circular saw, a reciprocating saw, a jigsaw, a hammer drill, a driver drill and a grinder.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

Additional representative embodiments (examples) of the present teachings include, but are not limited to:

1. A power tool comprising:
   a motor having a motor shaft,
   a pinion gear rotated by the motor shaft,
   a first planetary gear engaged with the pinion gear,
   a second planetary gear fixed to the first planetary gear and rotating with the first planetary gear,
   an internal gear engaged with the second planetary gear,
   a carrier holding the first planetary gear and the second planetary gear, and
   an output portion connecting to the carrier.
2. A power tool comprising:
   a motor having a motor shaft,
   a motor housing which houses the motor,
   a gear housing fixed to the motor housing,
   a bearing held in the gear housing, a pinion gear rotated by the motor shaft, a first planetary gear engaged with the pinion gear, a second planetary gear fixed to the first planetary gear and rotating with the first planetary gear, an internal gear engaged with the second planetary gear and fixed to the gear housing, a carrier holding the first planetary gear and the second planetary gear, and an output portion connecting to the carrier.

3. A power tool according to embodiment 1, wherein the first planetary gear may be fixed to a side close to the motor in the second planetary gear.

4. A power tool according to embodiment 2, wherein the first planetary gear may be fixed to a side close to the motor in the second planetary gear.

5. A power tool according to embodiment 1, wherein the first planetary gear may be fixed to a side close to the output portion in the second planetary gear.

6. A power tool according to embodiment 2, wherein the first planetary gear may be fixed to a side close to the output portion in the second planetary gear.

7. A rotary impact tool comprising:

an impact mechanism which impacts on an output portion in the power tool according to embodiment 1.

8. A rotary impact tool comprising:

an impact mechanism which impacts on an output portion in the power tool according to embodiment 1.

What is claimed is:

1. A power tool comprising:

a first housing which houses a motor;

a second housing connecting to the first housing through an elastic body disposed on an outer side of the first housing and on an inner side of the second housing, the elastic body configured to have a shock absorbing effect;

a control circuit board housed in the second housing and configured to control the motor;

a battery holding housing formed in the second housing; and a battery attached to the battery holding housing.

2. The power tool according to claim 1, wherein a grip housing is formed in the first housing, the first housing comprises a first half and a second half, a first screw is configured to fix the first haft of the first housing to the second half of the first housing, the second housing comprises a first half and a second half, and a second screw is configured to fix the first half of the second housing to the second half of the second housing.

3. The power tool according to claim 2, wherein a display portion displaying the state of the power tool is formed in the battery holding housing.

4. The power tool according to claim 3, wherein the control circuit board has a capacitor, and the capacitor is arranged in a center area in a right and left direction of the control circuit board.

5. The power tool according to claim 3, further comprising:

an impact mechanism configured to impact an output portion of the power tool.

6. The power tool according to claim 2, wherein the control circuit board is held through a case made of a resin.

7. The power tool according to claim 2, wherein the control circuit board has a capacitor, and the capacitor is arranged in a center area in a right and left direction of the control circuit board.

8. The power tool according to claim 2, further comprising:

an impact mechanism configured to impact an output portion of the power tool.

9. The power tool according to claim 2, wherein a trigger for energizing the motor is held by the grip housing.

10. The power tool according to claim 2, wherein the elastic body has a ring shape.

11. The power tool according to claim 1, wherein the control circuit board is held through a case made of a resin.

12. The power tool according to claim 1, wherein the control circuit board has a capacitor, and the capacitor is arranged in a center area in a right and left direction of the control circuit board.

13. The power tool according to claim 1, further comprising:

an impact mechanism configured to impact an output portion of the power tool.

* * * * *